United States Patent [19]

Hoshino

[11] 4,296,068

[45] Oct. 20, 1981

[54] APPARATUS FOR STERILIZING A SUCCESSION OF FOOD CONTAINERS OR THE LIKE

[75] Inventor: Masaru Hoshino, Tokyo, Japan

[73] Assignee: Dai Nippon Insatsu Kabushiki Kaisha, Tokyo, Japan

[21] Appl. No.: 121,730

[22] Filed: Feb. 15, 1980

[30] Foreign Application Priority Data

| | | | |
|---|---|---|---|
| Feb. 19, 1979 | [JP] | Japan | 54-17987 |
| Jul. 31, 1979 | [JP] | Japan | 54-105847[U] |
| Aug. 8, 1979 | [JP] | Japan | 54-101036 |
| Sep. 21, 1979 | [JP] | Japan | 54-121675 |

[51] Int. Cl.[3] ..... B08B 3/12; B08B 7/04

[52] U.S. Cl. ..... 422/62; 134/18; 134/72; 422/20; 422/105; 422/304

[58] Field of Search ..... 422/62, 119, 304, 105, 422/20; 134/18, 72

[56] References Cited

U.S. PATENT DOCUMENTS

| | | | |
|---|---|---|---|
| 1,734,585 | 11/1929 | Ladewig et al. | 422/304 X |
| 1,853,335 | 4/1932 | Cook | 422/304 X |
| 3,363,636 | 1/1968 | Weihe, Jr. | 134/72 |
| 4,193,818 | 3/1980 | Young et al. | 134/18 X |
| 4,231,806 | 11/1980 | Henry | 134/18 |

*Primary Examiner*—Ronald Serwin

*Attorney, Agent, or Firm*—Koda and Androlia

[57] ABSTRACT

Apparatus particularly suitable for sterilization of a succession of food containers being fed intermittently along a horizontal path, preparatory to the filling of such containers with a desired food. Formed over and under the feed path are two opposed sterilizing chambers into which a sterilizing solution is supplied in subdivided form for application to the successive containers. In some embodiments the sterilizing chambers are provided with spray nozzles for spraying the sterilizing solution onto the containers, while in others the sterilizing solution is ultrasonically atomized into fine mist in a separate atomizing section, the mist being then directed into the sterilizing chambers. The apparatus further includes heaters for heating the sterilizing chambers and other pertinent parts in order to afford subdivision of the sterilizing solution into fine, uniform droplets and to prevent their condensation into large drops.

26 Claims, 37 Drawing Figures

APPARATUS FOR STERILIZING A SUCCESSION OF FOOD CONTAINERS OR THE LIKE

BACKGROUND OF THE INVENTION

1. Field of the Invention

This invention relates generally to sterilizing apparatus and, particularly, to apparatus for sterilizing with a subdivided or atomized sterilizing liquid a succession of articles being fed along a predetermined path. According to one aspect of the invention the apparatus finds application to an integrated commodity packaging system which sterilizes, dries, fills with a desired commodity such as food, precision parts or pharmaceutical products, and lids or closes successive open-top containers or packages being fed in one or more files.

2. Description of the Prior Art

Japanese Patent Application Laid-Open No. 54-58583 discloses a food packaging system of the above described character. This system comprises a sterilizing section, drying section, filling section, and lidding section for performing the respective operations on successive open-top food containers being fed horizontally by a conveyor. Of all these packaging-line sections the sterilizing section demands the most attentive consideration for effective, thorough attainment of its end.

The sterilizing section of the cited prior art food packaging system has proved to be subject to some objections. One of these arises from the fact that its sterilizing chambers, in which a sterilizing liquid such as hydrogen peroxide solution or chlorine water is sprayed onto the successive containers, must move toward and away from the feed path of the containers. Such reciprocation of the sterilizing chambers requires the provision of complex drive, linkage, and guide mechanisms, as well as large installation spaces for such mechanisms.

Another objection is to the inadequate attention paid for proper atomization, and subsequent deposition on the containers, of the sterilizing liquid. A correct amount of the sterilizing liquid should be applied uniformly to the entire surfaces of each container in the form of as fine droplets as possible.

In the sterilizing section of the known food packaging system, however, the sterilizing chambers cool down during their travel away from the container feed path, when the heated sterilizing liquid is not supplied thereto. Thus, when sprayed into the chambers during their travel toward the feed path, the sterilizing liquid tends to condense into large drops on the inside surfaces of their walls. Such drops may fall onto the containers, making it difficult to speedily dry them in the subsequent drying section.

SUMMARY OF THE INVENTION

A general object of this invention is the provision of sterilizing apparatus which is materially simplified in construction but which nevertheless is capable of effectively sterilizing articles by the application thereto of the extremely fine, uniform mist of a sterilizing liquid, with a view in particular to the use of the apparatus in a food packaging system.

The sterilizing apparatus according to the invention is best characterized by two stationary, opposed sterilizing chambers formed on the opposite sides of a predetermined path along which articles to be sterilized are fed at least in one row. The sterilizing apparatus further comprises means for supplying a sterilizing liquid in subdivided form into the sterilizing chambers for sterilizing the successive articles traveling therebetween, and means for heating the sterilizing chambers and the supplying means.

The sterilizing liquid can be atomized either by spray nozzles mounted directly on the sterilizing chambers or by ultrasonic atomizing means of various possible constructions in communication with the sterilizing chambers. The heating of such supplying means and of the sterilizing chambers enables the creation of fine, uniform-sized droplets or mist particles and prevents their condensation into large drops in the sterilizing chambers. Each article can thus be sterilized with a minimum amount of the sterilizing liquid and quickly dried in the succeeding stage.

In the preferred embodiments hereinafter set forth, in which the sterilizing apparatus is incorporated in a food packaging system, the food containers to be filled with a food are fed intermittently in one or more rows. The provision of valves is preferred for the sterilization of such intermittently traveling articles. The valves are to be opened and closed either for causing the spray nozzles to spray the sterilizing liquid, or for permitting the delivery of the ultrasonically created mist of the sterilizing liquid from the atomizing means into the sterilizing chambers, only when each container or each group of containers are at rest between the sterilizing chambers.

A further feature of this invention resides in means for reducing the velocities of the sprays after they have been expelled from the spray nozzles. Such means include means defining a spray channel in each of the sterilizing chambers for the passage of the spray toward the articles being sterilized. The spray channels are laterally open to confined air chambers, such that the air chambers serve to reduce the velocities of the sprays. The thus retarded sprays can be reheated in the sterilizing chambers to such an extent as to preclude any possibility of condensing into large drops on the articles being sterilized.

Still further the invention features means for detecting the amount of the sterilizing liquid being sprayed or otherwise applied to each article or each group of articles. This goal is attained by optoelectronically ascertaining the density of the spray or mist in one or both of the sterilizing chambers. The electrical signal representative of the spray or mist density is integrated during each of successive preset periods of time, and the integral is compared with a predetermined reference representative of the correct amount of the sterilizing liquid to be applied during each period of time. The signals obtained as a result of this comparison find use, for example, for rejecting improperly sterilized articles, for readjusting the rate of application of the sterilizing agent, and for various other purposes.

The above and other objects, features and advantages of this invention and the manner of attaining them will become more apparent, and the invention itself will best be understood, from the following description taken together with the accompanying drawings.

BRIEF DESCRIPTION OF THE DRAWINGS

FIGS. 27A, 27B, 27C and 27D are waveform diagrams useful in explaining the operation of the spray density detecting system of FIG. 26;

DESCRIPTION OF THE PREFERRED EMBODIMENTS

General

The apparatus of this invention is intended primarily, but not necessarily, for sterilization of food containers. In this application the apparatus will afford its full benefits when incorporated into a commodity packaging system or apparatus of the type shown in FIG. 1. A brief description of this packaging system as for food will therefore be given first, followed by the detailed discussion of several preferable forms of the sterilizing apparatus as incorporated in the system.

Figure 1:
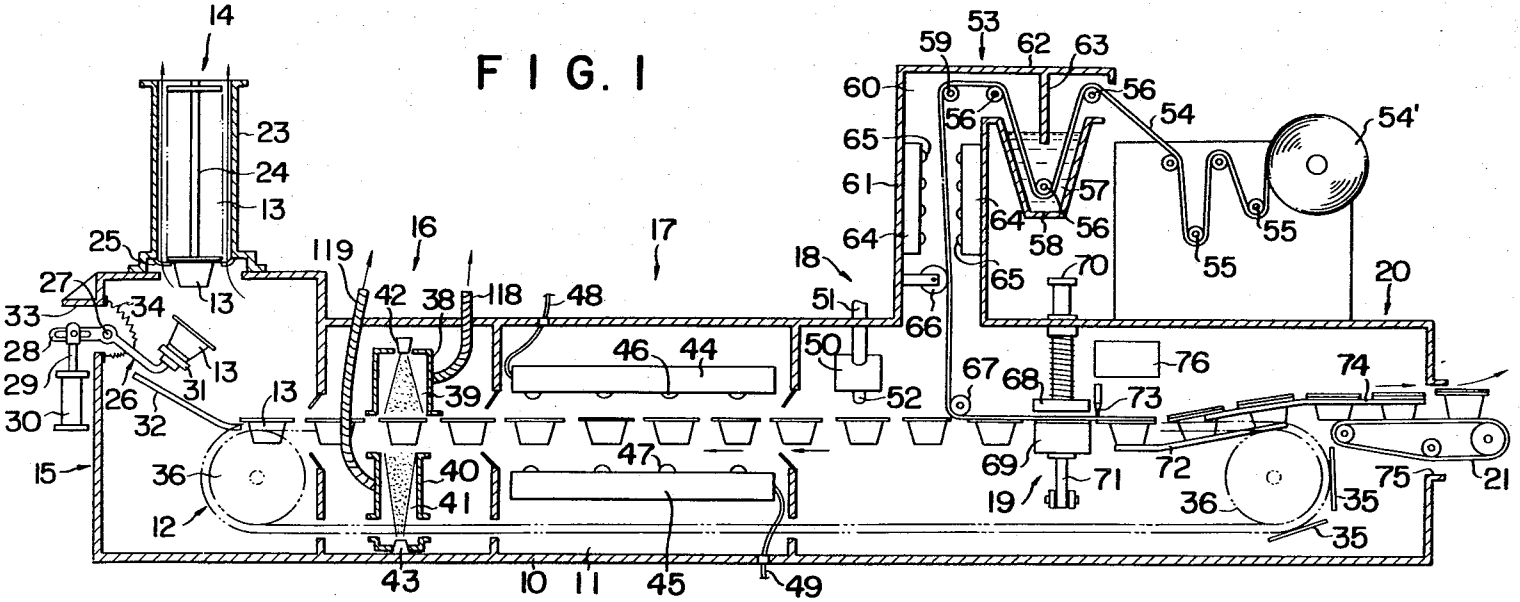
FIG. 1 is a schematic, vertical sectional view of a food packaging system including a sterilizing section, in which containers or packages are sterilized preparatory to being filled with a food, constructed in accordance with the present invention.

With reference to FIG. 1 the illustrated food packaging system broadly comprises:

(1) a generally boxlike enclosure or frame 10 providing a substantially hermetically sealed, processing space 11 therein;

(2) a container transport conveyor 12 mounted within the enclosure 10 for transporting successive open-top containers 13 from left to right through the processing space 11;

(3) an infeed section 14 on the left hand end of the enclosure 10 for holding a stack of containers 13 to be processed;

(4) a loading section 15 for successively carrying the containers 13 away from the infeed section 14 and loading them on the left hand end of the transport conveyor 12;

(5) a sterilizing section 16, in which resides the gist of this invention, for sterilizing the successive containers 13 on the transport conveyor 12;

(6) a drying section 17 for drying the successive sterilized containers 13;

(7) a filling section 18 for filling the successive dried containers 13 with a desired prepared food;

(8) a lidding section 19 for closing and sealing the open tops of the successive filled containers 13; and (9) a discharge section 20 including a discharge conveyor 21 for carrying the successive completed products out of the right hand end of the enclosure 10.

Figure 2:
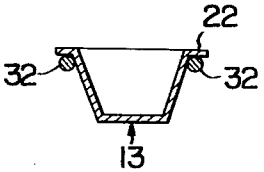
FIG. 2 is an enlarged, axial sectional view of each container to be sterilized and filled with a food in the apparatus of FIG. 1, the container being shown together with a pair of slide rails used in the loading section of the apparatus.

As illustrated on an enlarged scale in FIG. 2, each open-top container 13 for use with this apparatus is generally frustoconical in shape, tapering downwardly. An annular flange or rim 22 projects outwardly from its top. The containers 13 can be fabricated from any such material as aluminum, paper, or thermoplastic resins, or of combinations of such materials.

With reference back to FIG. 1 the infeed section 14 of the illustrated apparatus includes an upstanding holder frame 23 of tubular shape mounted on and airtightly fastened to the enclosure 10. A plurality (one shown) of angularly spaced guide posts 24 within the holder frame 23 receive the stack of containers 13 for downward sliding motion. A plurality of displaceable retainer pawls 25 at the bottom end of the holder frame 23 are sprung into engagement with the flange 22 of the lowermost container. Upon exertion of a downward pull on the lowermost container the retainer pawls 25 disengage its flange 22 and so release only the lowermost container, being immediately sprung back into engagement with the flange of the next container.

The loading section 15 includes a bell crank 26 pivoted at 27 to a suitable stationary part of the apparatus. One end 28 of the bell crank 26 is operatively coupled to the piston rod 29 of an air cylinder 30, which preferably is disposed exteriorly of the enclosure 10 as shown. Lying under the holder frame 23, the other end of the bell crank 26 carries a member 31 capable of adhering to the bottom of the lowermost container in the holder frame. The loading section 15 further includes a chute 32 comprising a pair of sloping, parallel spaced slide rails (FIG. 2) for sliding engagement with the flange 22 of each container 13.

Thus, upon contraction of the air cylinder 30, the bell crank 26 pivots in a counterclockwise direction until the member 31 thereon abuts against and adheres to the bottom of the lowermost one of the stacked containers 13 in the holder frame 23. The subsequent extension of the air cylinder 30 causes clockwise turn of the bell crank 26, with the lowermost container carried by its member 31. The clockwise turn of the bell crank 26 continues until the member 31 descends past the chute 32, traveling between its pair of slide rails, sufficiently downwardly to leave the container 13 in engagement therewith. Thus deposited on the chute 32, the container 13 slides down onto the container transport conveyor 12.

An opening is formed at 33 in the enclosure 10 to permit the bell crank 26 to project out of the same for connection to the air cylinder 30. A bellowslike member 34 airtightly closes the opening 33 without interfering with the pivotal motion of the bell crank 26, in order to prevent the intrusion of airborne contaminants into the processing space 11.

Figure 3:
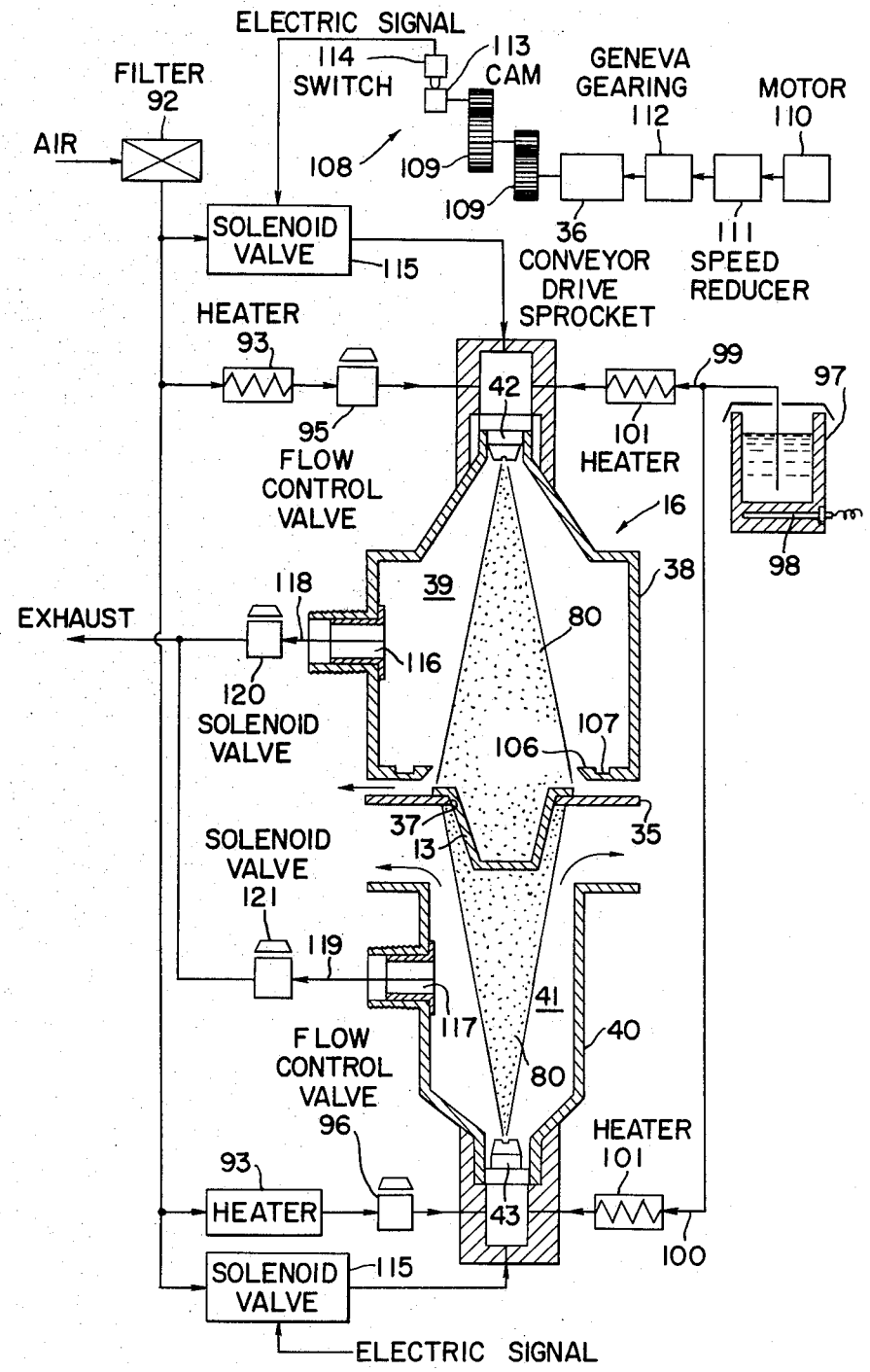
FIG. 3 is a schematic, vertical sectional view showing the sterilizing section as seen transversely of the apparatus of FIG. 1, the view also showing in block-schematic form various means associated with or included in the sterilizing section.

As will be seen also from FIG. 3, the container transport conveyor 12 includes an endless series of container carrier plates 35 operating over terminal sprockets or pulleys 36. Each container carrier plate 35 has formed therein a central opening 37 for receiving one of the containers 13, with its flange 22 resting on the holder plate. The series of container carrier plates 35 travels intermittently in timed relationship to the pivotal motion of the bell crank 26, in such a way that the successive containers 13 from the container holder frame 23 fall into the openings 37 of the respective carrier plates.

The continuous row of containers 13 are thus fed horizontally through the processing space 11 by the upper run or span of the container transport conveyor 12. During this horizontal travel the containers 13 undergo sterilizing, filling, and other packaging-line operations hereinafter set forth.

Lying next to the loading end of the container transport conveyor 12 is the sterilizing section 16 for applying a finely subdivided sterilizing liquid to the successive containers 13 from their opposite sides (above and below). The sterilizing section 16 as illustrated in FIG. 1 is highly schematic. It will nevertheless be seen that this section 16 comprises an upper wall assembly 38 overlying the upper span of the container transport conveyor 12 to define an upper sterilizing chamber 39 and, thereunder, a lower wall assembly 40 defining a lower sterilizing chamber 41.

The upper wall assembly 38 is closed at the top and open at the bottom. A spray nozzle 42 is mounted on the closed top of the upper wall assembly 38 for producing a subdivided stream of a sterilizing liquid directed downwardly. The lower wall assembly 40, on the other hand, is open at the top and closed at the bottom. A spray nozzle 43 is mounted on the closed bottom of the lower wall assembly 40 for producing a subdivided stream of the sterilizing liquid directed upwardly.

The successive containers 13 are thus sprayed with the sterilizing liquid, both from above and below, while being held at rest between the upper and lower sterilizing chambers 39 and 41. Further details of this sterilizing section 16 will be given later in connection with FIGS. 3 through 5.

Next to be referred to is the drying section 17 for drying the sterilized containers 13 on the container transport conveyor 12. The drying section 17 comprises an upper 44 and a lower 45 air box disposed on the upper and lower sides, respectively, of the upper flight of the container transport conveyor 12 and extending therealong. The upper air box 44 has a row of constantly spaced air nozzles 46 directed downwardly. The lower air box 45 likewise has a row of constantly spaced air nozzles 47 directed upwardly.

The upper and lower air boxes 44 and 45 receive filtered and heated air under pressure by way of respective conduits 48 and 49. Expelled from the nozzles 46 and 47, the clean, heated air is applied to the containers 13 on the conveyor 12 both from above and below. The successive containers 13 coming out of the sterilizing section 16 are thus dried and freed from the sterilizing agent as they subsequently travel between the two air boxes 44 and 45.

The thus dried containers 13 enter the filling section 18. This section includes a dispenser 50 of a suitably prepared, thoroughly sterilized or pasteurized food conveyed through a conduit or chute 51. While being held at rest under the spout 52 of the dispenser 50, each container 13 receives a prescribed quantity of the food therefrom.

Subsequently fed into the lidding section 19, the filled containers 13 have their open tops lidded and sealed. The lidding section 19 is provided with a lid blank supply section 53 for receiving therefrom a lid blank 54 in the form of a continuous strip of, for example, aluminum, plastics, or a laminate of plastics and paper. The lid blank 54 has a coating of a heat sealing agent on one of its surfaces.

The lid blank supply section 53 has a roll 54' of the lid blank 54 mounted external to the enclosure 10. Unwound from this roll, the lid blank 54 passes over a series of tension rolls 55 and is bent into the shape of a V by three guide rolls 56 thereby to be dipped in a sterilizing liquid 57 contained in a tank 58. The sterilizing liquid 57 may be either hydrogen peroxide solution or chlorine water.

On emerging from the sterilizing bath the lid blank 54 turns downwardly by passing over a guide roll 59 and enters a drying chamber 60 included in the lid blank supply section 53. The drying chamber 60 is defined by an upstanding enclosure 61 communicatively connected at its bottom end to the enclosure 10. The drying chamber enclosure 61 is formed integral with the sterilizing liquid tank 58 and its ceiling 62. A wall 63 depending from the ceiling 62 is partly immersed in the sterilizing liquid 57 in the tank 58 and thus serves to close the drying chamber 60 and therefore the processing space 11 against the intrusion of atmospheric air.

The drying chamber 60 has a pair of air boxes 64 mounted on the inside surfaces of its enclosure 61 and disposed on the opposite sides of the lid blank 54 passing downwardly therethrough. Each air box 64 has a series of air nozzles 65 directed toward the lid blank 54. Filtered and heated air is forced into the air boxes 64 from a suitable source (not shown) of such air and expelled from the nozzles 65. The lid blank 54 that has been dipped in the sterilizing bath is thus dried during its subsequent travel through the drying chamber 60.

The dried lid blank 54 passes over a pitch corrector roll 66 and then enters the lidding section 19 within the enclosure 10. In this lidding section the lid blank 54 is turned right-angularly by a guide roll 67 so as to extend horizontally over the successive containers 13 on the conveyor 12. The surface of the lid blank 54 coated with the heat sealing agent is now oriented downwardly.

The lidding section 19 comprises a hot stamping die 68 and anvil 69 which coact to attach the lid blank 54 to the flanges 22 of the containers 13 under heat and pressure. The stamping die 68 has a built-in heater or heaters (not shown) and is thereby heated to a controlled temperature. An air cylinder 70 mounted external to the enclosure 10 has its piston rod coupled to the stamping die 68 for imparting up-and-down motion thereto. Suitable means may be employed to avoid the entrance of contaminants into the processing space 11 from the external air cylinder 70. The anvil 69 is coupled to and moved up and down by a crank mechanism 71.

Each container 13 with its carrier plate 35 rides over the anvil 69 when the latter is lowered by the crank mechanism 71. Then elevated, the anvil 69 holds the container 13 ready for attachment of the lid blank 54 thereto. Then the air cylinder 70 acts to lower the hot stamping die 68, which presses the lid blank 54 against the flange 22 of the container 13 on the anvil 69. The container 13 is now hermetnically closed and sealed with the lid blank 54.

After the lidded container 13 has subsequently ridden on a guideway 72, a vertically reciprocating cutter 73 descends and severs the lid blank 54 midway between two succeeding ones of the container carrier plates 35. This marks the end of the series of packaging-line operations performed on the containers 13.

The guideway 72 provides an upward slope over which the containers 13 are fed by the transport conveyor 12. The containers 13 thus sliding over the guideway 72 have their flanges 22 caught by a pair of parallel spaced guide rails 74 (one seen). These guide rails serve to raise the containers 13 away from the container carrier plates 35, further acting as a bridge for the transfer of the containers from transport conveyor 12 to discharge conveyor 21. Thus placed on the discharge conveyor 21, the containers 13 travel out of the enclosure 10 through its exit opening 75.

The enclosure 10 has formed therein an air inlet 76 which preferably should be located in the lidding section 19, as shown, or thereabouts. During the operation of the food packaging system the air inlet 76 is in constant communication with means (not shown) for supplying filtered air under pressure. The clean air forced into the processing space 11 from the inlet 76 partly flows to the right, through the discharge section 20, and leaves the enclosure 10 through the exit opening 75. The rest of the incoming clean air flows to the left, through the filling section 18, drying section 17, sterilizing section 16, loading section 15, and infeed section 14, leaving the enclosure 10 through the open top of the container holder frame 23.

Thus the divided flow of the clean air prevents the entrance of any contaminants into the processing space 11. The location of the air inlet 76 is such that the clean air flows reversely, so to say, through the sterilizing section 16. This is effective to avoid the intrusion into the succeeding sections of the contaminants that may be carried into the processing space 11 by the containers 13. The reverse flow of the clean air through the sterilizing section 16 serves also to prevent the mist of the sprayed sterilizing liquid from leaking into the drying section 17.

Figure 4:
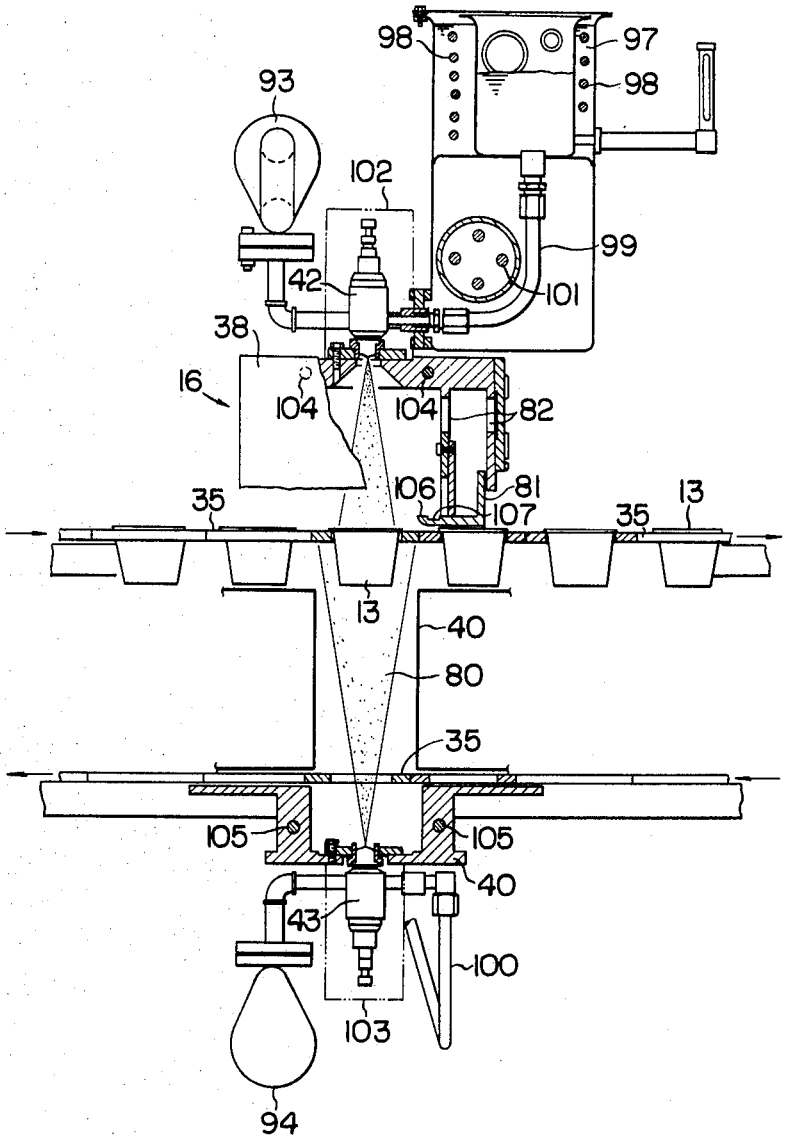
FIG. 4 is a vertical sectional view, partly in elevation and partly broken away for clarity, showing the sterilizing section of FIG. 3 in greater detail and as seen longitudinally of the apparatus of FIG. 1.
Figure 5:
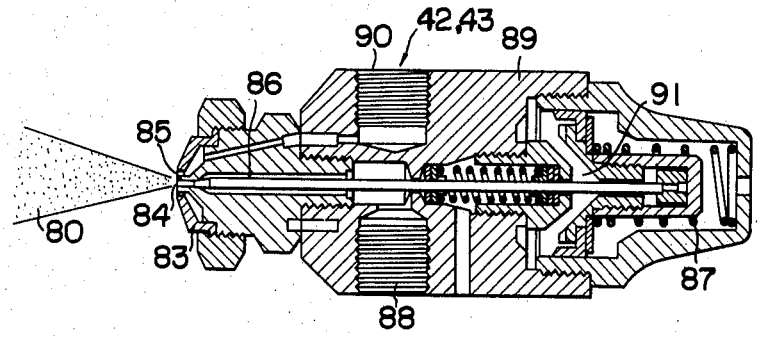
FIG. 5 is an enlarged, axial sectional view of one of the two identical spray nozzles used in the sterilizing section of FIGS. 1, 3 and 4.

Embodiment of FIGS. 3–5

What follows is the detailed description of the sterilizing section 16 as the first preferable embodiment of the invention, with reference had to FIGS. 3, 4 and 5. As has been mentioned, the sterilizing section 16 comprises the upper wall assembly 38 having the spray nozzle 42, and the lower wall assembly 40 having the spray nozzle 43. The upper and lower wall assemblies 38 and 40 are opposed to each other across the upper flight of the container transport conveyor 12.

In this particular embodiment of the invention, the lower span of the container transport conveyor 12 extends through the lower wall assembly 40, as best seen in FIG. 4. (FIG. 3 does not show this fact because it illustrates simply the working principle of the sterilizing section 16). This arrangements presents no problem since the spray 80 of the sterilizing liquid from the lower spray nozzle 43 can pass through the central opening 37 in each container carrier plate 35 of the container transport conveyor 12. If desired or required, however, the lower span of the conveyor 12 may be made to pass under the lower wall assembly 40.

FIG. 4 also shows that lower parts 81 of the upper wall assembly 38 are made movable up and down. The movable wall parts 81 are to be held in the lowermost possible position to minimize the leakage of the sprayed sterilizing liquid along the path of the containers 13. Further the upper wall assembly 38 has observation ports formed as at 82 to enable visual inspection of the spraying of the successive containers 13.

The upper and lower spray nozzles 42 and 43 can be identical in construction, as shown in detail in FIG. 5. Each spray nozzle has formed in its nose 83 a discharge opening 84 for the sterilizing liquid and an annular discharge slit 85 for clean, heated air, with the air discharge slit 85 closely encircling the liquid discharge opening 84. A needle valve 86 under the bias of a compression spring 87 normally holds the liquid discharge opening 84 out of communication with a liquid inlet port 88 formed in a nozzle body 89. The air discharge slit 85 is in constant communication with an air inlet port 90 also formed in the nozzle body 89.

Thus, upon delivery of pressurized air into an air chamber 91 in each spray nozzle, the needle valve 86 shifts to the right against the bias of the compression spring 87 thereby opening the liquid discharge hole 84 and permitting the ejection of the sterilizing liquid therefrom. Since clean, heated air is being constantly expelled from the air discharge slit 85, the ejected sterilizing liquid is thereby subdivided into droplets to form the conical spray 80. The operation of the needle valve 86 is to be controlled, by means described later, in relation to the intermittent advancement of the containers 13 through the processing space 11.

FIG. 3 shows means for supplying the clean, heated air to the spray nozzles 42 and 43. Such means include a filter 92 for receiving atmospheric air under pressure. The air filter 92 communicates with two heaters 93 in parallel arrangement, which in turn communicate with the two spray nozzles 42 and 43 via flow control valves 95 and 96, respectively. The filtered and heated air is constantly delivered to the air inlet ports 90 of the spray nozzles 42 and 43 at controlled rates. The construction of the heaters 93 will be later described in connection with FIG. 6.

At 97 in FIGS. 3 and 4 is shown a tank containing the sterilizing liquid to be sprayed onto the containers 13. The sterilizing agent may be either hydrogen peroxide solution, alcohol or chlorine water. The tank 97 has a built-in heater 98 for preheating the sterilizing liquid. The tank 97 communicates with the spray nozzles 42 and 43 by way of respective conduits 99 and 100 extending past a common heater or respective heaters 101. The heater or heaters 101 serve to reheat the preheated sterilizing liquid on its way to the spray nozzles 42 and 43.

Further, as shown in FIG. 4, additional heaters 102 and 103 are disposed adjacent the respective spray nozzles 42 and 43, and further additional heaters 104 and 105 are built into the respective wall assemblies 38 and 40. The heaters 101, 102 and 103 prevent the preheated sterilizing liquid from cooling in the conduits 99 and 100 and in the spray nozzles 42 and 43, particularly when the liquid is not being sprayed, so that the liquid can be dispersed into fine droplets at intervals. The heaters 104 and 105, heating the sterilizing chambers 39 and 41, minimize the condensation of the sprayed sterilizing liquid on the inside surfaces of the wall assemblies 38 and 40.

Condensation may nevertheless take place on the inside surfaces of the wall assemblies 38 and 40. This is undesirable, particularly in the case of the upper wall assembly 38, because the large drops of the sterilizing liquid may stream down to the containers 13 on the conveyor 12. The embodiment of FIGS. 3 and 4 eliminates this possibility by providing inwardly turned flanges 106 at the bottom end of the upper wall assembly 38. The flanges 106 have gutters 107 formed therein for collecting the large drops that may stream down the inside surfaces of the upper wall assembly 38.

A variety of actuating mechanisms can serve the purpose of opening the needle valves 86 of the spray nozzles 42 and 43 each time one of the containers 13 on the conveyor 12 stays between the upper and lower sterilizing chambers 39 and 41. FIG. 3 shows an example 108 of such actuating mechanisms.

The exemplified actuating mechanism 108 includes a set of reduction gears 109 driven by the drive sprocket 36 of the container transport conveyor 12 given in FIG. 1. The drive sprocket 36, by the way, is driven from an electric motor 110 via a speed reducer 111 and Geneva gearing 112 of well known construction for intermittently moving the endless series of container carrier plates 35 in step with the operation of the loading section 15. The final element of the reduction gears 109 is coupled to a cam wheel 113 capable of actuating a switch 114 at intervals. The electrical signal produced by the switch 114 actuates a solenoid valve 115 for controlling communication between the air filter 92 and the air chamber 91 of each spray nozzle 42 or 43. The solenoid valve 115 may be either shared by both of the spray nozzles 42 and 43 or, as shown in FIG. 3, provided for each spray nozzle.

Thus, each time one of the containers 13 on the conveyor 12 reaches the position between the upper and lower sterilizing chambers 39 and 41, the spray nozzles 42 and 43 produce the conical streams 80 of subdivided sterilizing solution for application to the container. The sterilizing solution is heated as aforesaid by the heaters 98, 101, 102, 103, 104 and 105. Moreover, since the spray nozzles 42 and 43 supply heated air into the sterilizing chambers 39 and 41 even while the conveyor 12 is moving, the sprayed sterilizing liquid can be finely and uniformly atomized for efficient sterilization of the containers 13.

With reference to FIG. 3, the upper and lower wall assemblies 38 and 40 are provided with respective exhaust ports 116 and 117 for removal of any excess of the sprayed sterilizing liquid from the sterilizing chambers 39 and 41. The exhaust ports 116 and 117 communicate by way of conduits 118 and 119 with means (not shown) for creating a partial vacuum therein. Solenoid valves 120 and 121 provided in the exhaust conduits 118 and 119 are to be opened only while the container transport conveyor 12 is moving. Thus the excess droplets or mist of the sprayed sterilizing liquid can be exhausted from the sterilizing chambers 39 and 41 while each new container is being transported to the chambers.

Figure 6:
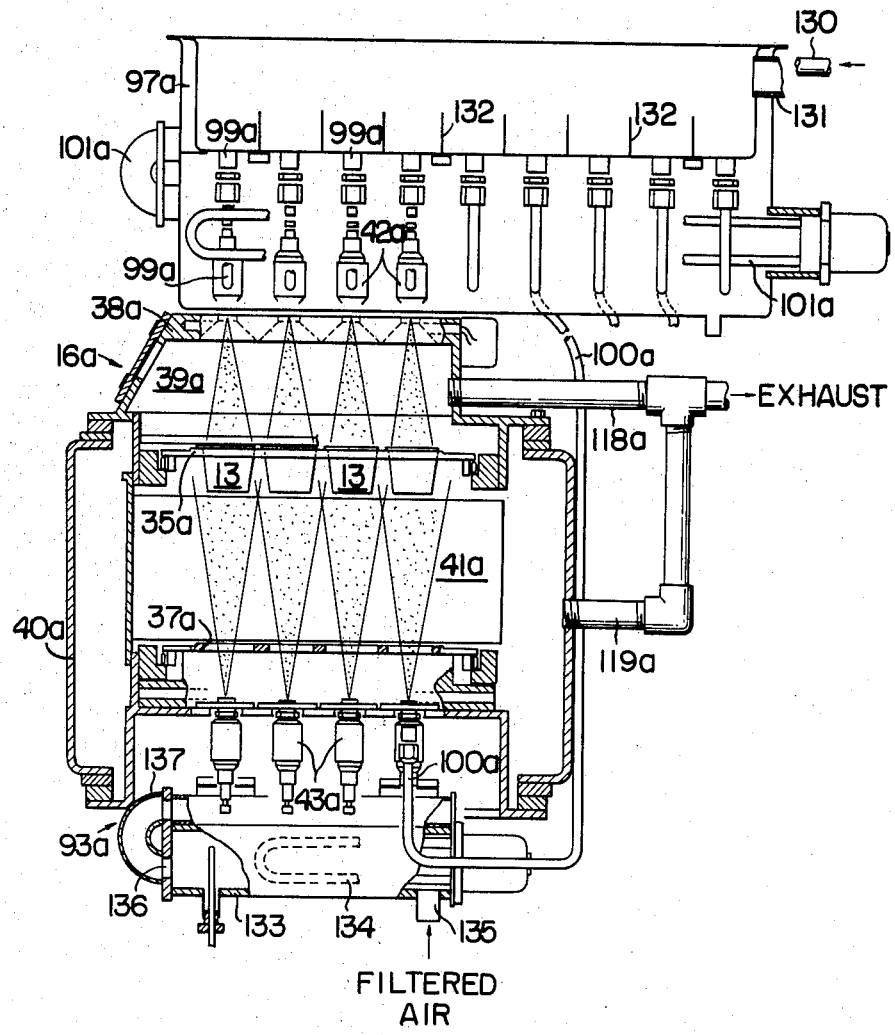
FIG. 6 is a vertical sectional view of a modified sterilizing section for use in a food packaging system in which containers are fed in several rows.

Embodiment of FIG. 6

Although the containers 13 may travel through the processing space 11 in a single file, as in the above embodiment, they can be more efficiently processed if fed in two or more rows. FIG. 6 shows a modified sterilizing section **16*a*** embodying this multiple-row principle.

Each container carrier plate 35*a* of the container transport conveyor for use with the modified sterilizing section 16*a* has formed therein a plurality of, four in this embodiment, container-receiving holes 37*a* aligned transversely of the conveyor. The modified sterilizing section 16*a* comprises an upper wall assembly 38*a* defining an upper sterilizing chamber 39*a*, and a lower wall assembly 40*a* defining a lower sterilizing chamber 41*a*. The upper wall assembly 38*a* supports four spray nozzles 42*a* directed toward the four containers 13 carried by each container carrier plate 36*a*. The lower wall assembly 40*a* likewise supports four spray nozzles 43*a* directed toward the four containers 13. At least the lower spray nozzles 43*a* are so distanced from the containers 13 and from each other that the conical streams of subdivided sterilizing liquid produced thereby overlap each other.

The sterilizing liquid is stored in a tank 97*a* having a supply conduit 130 and overflow conduit 131. Partitions 132 divide the interior of the tank 97*a* into several sections in communication with the spray nozzles 42*a* and 43*a* by way of conduits 99*a* and 100*a*, respectively. The conduits 99*a* and 100*a* extend past a heater 101*a* for heating the sterilizing liquid flowing toward the spray nozzles 42*a* and 43*a*. The tank 97*a* is assumed to have a built-in heater (not shown) similar to the heater 98 of FIG. 4.

The upper and lower sterilizing chambers 39*a* and 41*a* communicate with respective exhaust conduits 118*a* and 119*a* for exhausting any excess of the sprayed sterilizing liquid therefrom. The lower wall assembly 40*a* extends upwardly beyond the upper span of the container transport conveyor to permit effective removal of the excess mist or droplets from the region immediately surrounding the containers 13.

Shown at 93*a* and 101*a* are heaters similar in construction and function to the heaters 93 and 101 of FIGS. 3 and 4. Each of these heaters 93*a* and 101*a* includes a large diameter pipe 133 having a built-in electric heater wire 134. Filtered air is forced into the pipe 133 through an inlet 135 to be heated therein. Leaving the pipe 133 through its outlet 136, the heated air is directed by a small diameter pipe 137 to the air inlet ports 90 of the spray nozzles 42*a* or 43*a*.

The other details of construction and operation of this modified sterilizing section 16*a* are substantially identical with those set forth in connection with the sterilizing section 16 of FIGS. 3 and 4. Corresponding modifications of the other sections of the food packaging system shown in FIG. 1 will readily occur to one skilled in the art.

Figure 7:
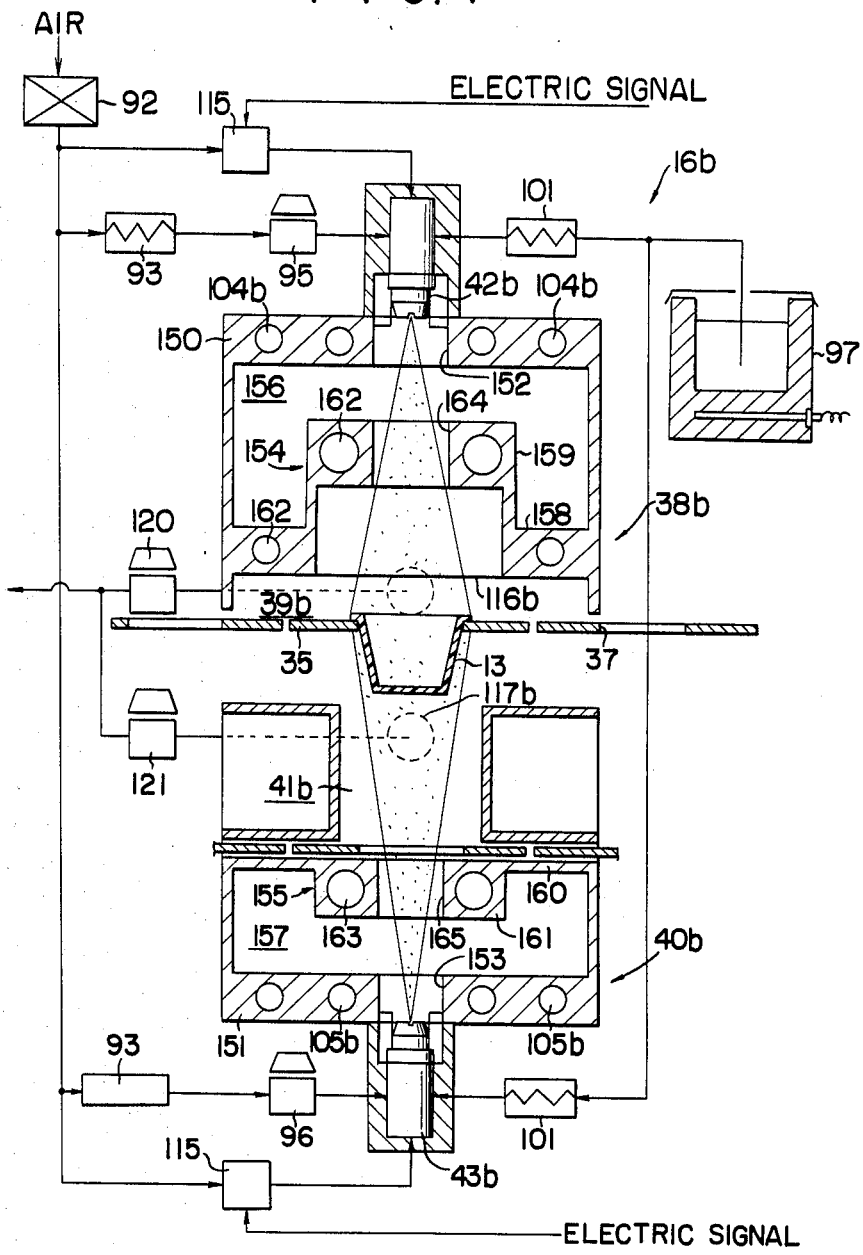
FIG. 7 is a vertical sectional view of another modified sterilizing section, including means for retarding the sprays being applied to the containers.

Embodiment of FIG. 7

In spite of their decided advantages over the prior art, the sterilizing sections 16 and 16*a* presented in the foregoing have the problem that the velocities of the sprays expelled by the nozzles 42, 43, 42*a* and 43*a* are rather inconveniently high. This means that the sprayed droplets of the sterilizing liquid are not sufficiently heated in the sterilizing chambers, before depositing on the container or containers being sterilized. Such insufficiently heated droplets are easy to condense into large drops on the containers, resulting in nonuniform sterilization of their surfaces and making it difficult to speedily dry them in the subsequent drying section.

Avoidance of these difficulties is possible simply by reducing the velocities of the sprays to a required degree. The pressures under which the sterilizing liquid and air are fed into the spray nozzles should not be decreased, however, for the accomplishment of this objective. Reduction in pressure would result in an increase in the diameters of the spray particles and in a decrease in the rate at which the sterilizing liquid is sprayed. The spray velocities must be reduced without decreasing the fluid pressures.

FIG. 7 shows a sterilizing section 16*b* meeting the above seemingly self-contradictory requirement. Intended for use in the food packaging system of FIG. 1, this modified sterilizing section also comprises an upper wall assembly 38*b* defining an upper sterilizing chamber 39*b*, and a lower wall assembly 40*b* defining a lower sterilizing chamber 41*b*. A spray nozzle 42*b* on the top wall 150 of the upper wall assembly 38*b* and another spray nozzle 43*b* on the bottom wall 151 of the lower wall assembly 40*b* can each be identical with the spray nozzle shown in detail in FIG. 5.

The top wall 150 of the upper wall assembly 38*b* has a cylindrical bore 152 formed therein just under and in axial alignment with the upper spray nozzle 42*b*. The bore 152 serves as a passage for the spray issuing from the upper nozzle 42*b*. The bottom wall 151 of the lower wall assembly 40*b* has likewise formed therein a cylindrical bore 153 just over and in axial alignment with the lower spray nozzle 43*b*. This bore 153 serves as a passage for the spray emitted by the lower nozzle 43*b*.

The most pronounced feature of the sterilizing section 16*b* resides in partitions 154 and 155 formed integral with the upper 38*b* and the lower 40*b* wall assemblies, respectively. The partitions 154 and 155 confine parts of the sterilizing chambers 39*b* and 41*b* to provide air chambers 156 and 157, respectively. Although slightly different in shape, the partitions 154 and 155 are identical in function.

The upper partition 154 comprises a horizontal portion 158, parallel to the container carrier plates 35, and a cylindrical portion 159 formed centrally of the horizontal portion 158 and projecting toward the upper spray nozzle 42*b*. The lower partition 155 likewise comprises a horizontal portion 160 and a cylindrical portion 161, the latter projecting toward the lower spray nozzle 43*b*.

A heater or heaters 162 mounted within the horizontal portion 158 and cylindrical portion 159 of the upper partition 154 heat both upper sterilizing chamber 39*b* and upper air chamber 156. A heater 163 mounted within the cylindrical portion 161 of the lower partition 155 heats both lower sterilizing chamber 41*b* and lower air chamber 157.

The cylindrical portions 159 and 161 of the partitions 154 and 155 have respective cylindrical bores 164 and 165 formed therethrough in axial alignment with the bores 152 and 153. The bores 152 and 164 provide in combination a spray channel for the passage of the spray from the upper spray nozzle 42*b* toward the container 13. The bores 153 and 165 also provide in combination a spray channel for the passage of the spray from the lower spray nozzle 43*b* toward the container 13. The spray channel formed by the bores 154 and 164 is open on all sides to the air chamber 156, and the spray channel formed by the bores 153 and 165 is open on all sides to the air chamber 157. Seen at 116*b* and 117*b* are exhaust ports open to the respective sterilizing chambers 39*b* and 41*b*.

As Bernoulli's principle states, where the velocity of a fluid is high the pressure is low, and where the velocity of a fluid is low the pressure is high. Thus, when the streams of airborne droplets pass through the spray channels formed by the bores 152 and 164 and by the bores 153 and 165, the pressures in these channels become lower than the pressures in the air chambers 156 and 157. The pressure differentials cause the air to flow from the air chambers 156 and 157 into the respective spray channels thereby reducing the pressures in these chambers. The energies thus expended by the sprays cause a decrease in their velocities.

Since the sterilizing chambers **39*b* and 41*b*, the air chambers 156 and 157, and the spray channels are all heated by the heaters 162 and 163 and by heaters 104*b* and 105*b* in the top walls 150 and 151 of the wall assemblies 38*b* and 40*b*, the sprays of reduced velocities can be heated to a temperature range of, for example, 50° to 80° C. before reaching the container 13**. The heated droplets of the sterilizing liquid deposit uniformly on the container, without the possibility of condensing into large drops thereon. Complete sterilization of the successive containers is possible by spraying each container for several seconds.

The other details of construction and operation of this sterilizing section **16*b* are as set forth above in connection with FIGS. 3 and 4 in particular. It will also be seen that the teachings of FIG. 7 apply to the sterilizing section 16*a* of FIG. 6**.

Figure 8:
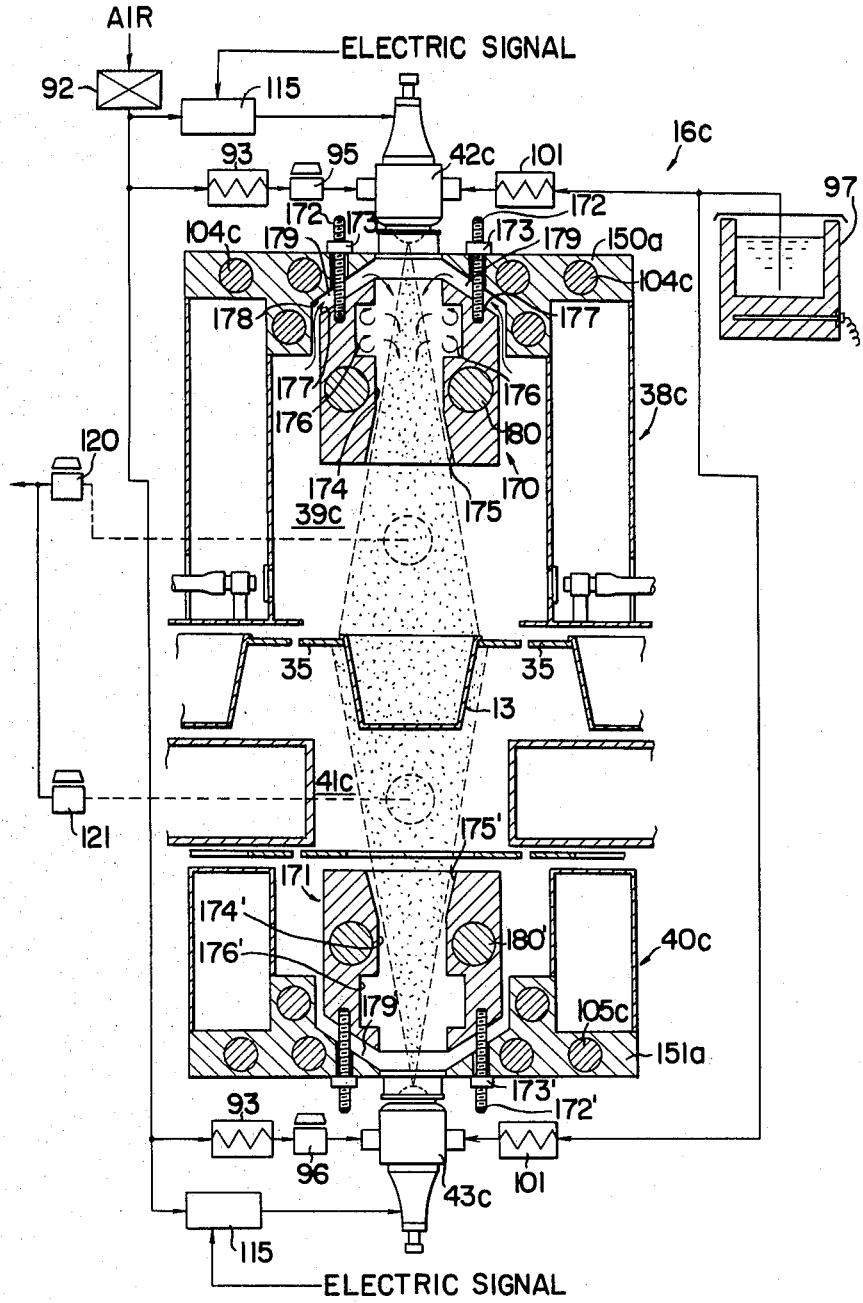
FIG. 8 is a vertical sectional view of still another modified sterilizing section, also including means for retarding the sprays being applied to the containers.
Figure 9:
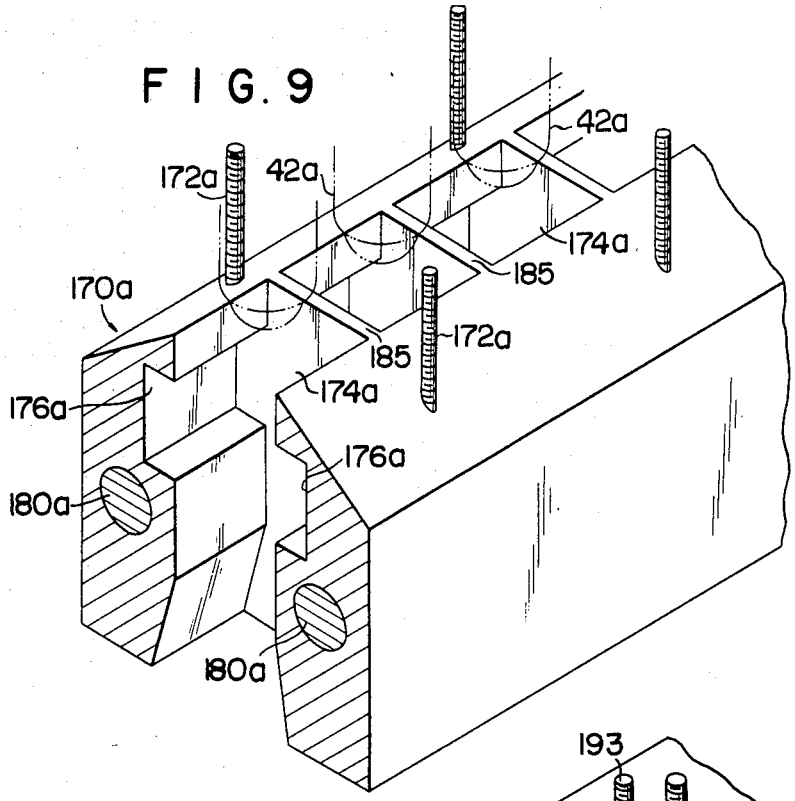
FIG. 9 is a fragmentary perspective view of one of two identical spray retarder blocks similar to those employed in the sterilizing section of FIG. 8 but herein shown adapted for use in the sterilizing section of the type given in FIG. 6.
Figure 10:
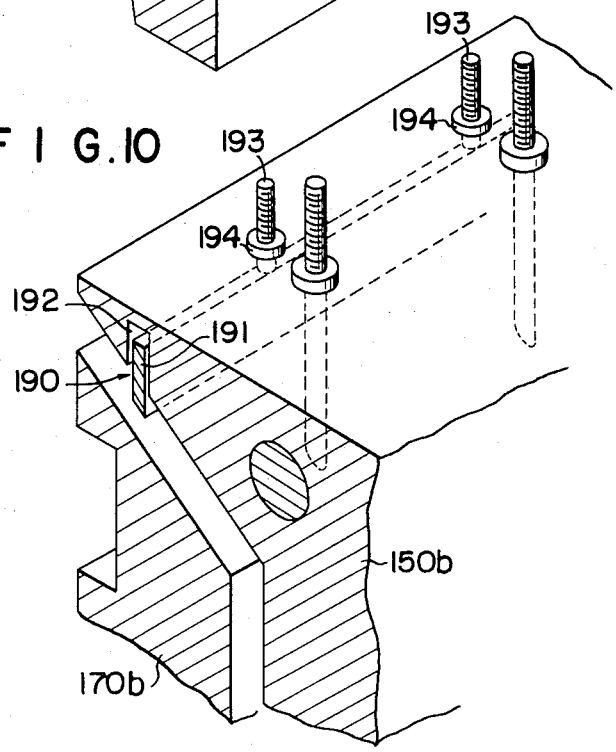
FIG. 10 is a fragmentary perspective view of a slight modification of the sterilizing section of the type shown in FIG. 8 or 9.

Embodiments of FIGS. 8–10

The sterilizing section **16*b* of FIG. 7 has its own problem. Since the mist streams from the spray nozzles 42*b* and 43*b* create turbulence in the air chambers 156 and 157**, the mist tends to attach to the exposed surfaces of the nozzles, especially when the apparatus is in continuous operation for an extended length of time. Mist attachment to the upper spray nozzle is a particular nuisance because such mist may collect into large drops and fall onto the container being sterilized.

A further modified sterilizing section **16*c* shown in FIG. 8 provides a solution to the above problem, besides possessing an advantage absent from the preceding sterilizing section 16*b*. The sterilizing section 16*c* also comprises an upper wall assembly 38*c* defining an upper sterilizing chamber 39*c*, and a lower wall assembly 40*c* defining a lower sterilizing chamber 41*c*. A spray nozzle 42*c* on the top wall 150*a* of the upper wall assembly 38*c* and another spray nozzle 43*c* on the bottom wall 151*a* of the lower wall assembly 40*c* can each be identical in construction with the spray nozzle of FIG. 5**.

In the upper and lower sterilizing chambers **39*c* and 41*c* there are mounted spray retarder blocks 170 and 171, respectively, which best characterize this sterilizing section 16*c*. The two spray retarder blocks 170 and 171 are of identical construction, so that only the upper block 170 will be described in detail together with means closely associated therewith. Various parts of the lower spray retarder block 171, as well as means directly related thereto, will be identified merely by priming the reference numerals used to denote the corresponding parts of the block 170** and its associated means.

Generally of boxlike shape, the upper spray retarder block 170 is suspended from, or connected to, the top wall **150*a* of the upper wall assembly 38*c* solely by a plurality of fastener elements such as hanger bolts or threaded rods 172 complete with nuts 173. The spray retarder block 170 thus lies under the upper spray nozzle 42*c* and is physically separated from the top wall 150*a***.

A spray channel 174, which is of rectangular cross section in this particular embodiment, extends vertically through the spray retarder block 170 for the passage therethrough of the spray issuing from the spray nozzle **42*c*. The lowermost portion 175 of the spray channel 174 flares to conform to the conical shape of the spray. The spray retarder block 170 has further formed therein a pair of opposed air chambers 176 open to the opposite sides of the spray channel 174. The air chambers 176 correspond to the air chamber 156 in the sterilizing section 16*b* of FIG. 7. If desired, only one such air chamber 176 may be formed so as to surround the spray channel 174**.

The top of the spray retarder block 170 is shaped into slant surfaces 177 which are opposed to correspondingly sloping surfaces 178 of the top wall **150*a* of the upper wall assembly 38*c*. The spaces between these opposed surfaces serve as air passages 179 from the sterilizing chamber 39*c* to the entrance end of the spray channel 174. The spray retarder block 170 has a built-in heater or heaters 180. Additional heaters 104*c* and 105*c* are mounted respectively in the top wall 150*a* of the upper wall assembly 38*c* and in the bottom wall 151*a* of the lower wall assembly 40*c***.

In operation the sprays expelled by the spray nozzles **42*c* and 43*c* pass through the respective spray channels 174 and 174' in the spray retarder blocks 170 and 171. As has been explained in connection with the sterilizing section 16*b* of FIG. 7, the air chambers 176 and 176' open to the spray channels 174 and 174'** function to reduce the velocities of the sprays passing therethrough.

Experiment has proved that for the best results, at least the inside surfaces of the spray retarder blocks 170 and 171 should be heated by the heaters 180 and 180' to a temperature range of 120° to 135° C., particularly if the sterilizing agent in use is hydrogen peroxide solution and if its sprays have a temperature ranging from 90° to 100° C. just when emitted from the nozzles **42*c* and 43*c***. Should the spray retarder block surface temperature be less than about 120° C., the turbulent flows of the mist would wet the block surfaces. The wetted block surfaces would not dry in less than one second, inviting mist condensation if the apparatus were maintained in a prolonged run of operation. Should the block surface temperature be in excess of about 135° C., on the other hand, the mist particles would spring back, so to say, upon contact with the block surfaces and might fall in large drops on the container being sterilized. The mist will smoothly gasify on contact with the block surfaces only when their temperature is in the noted range of 120° to 135° C.

Emerging from the channels 174 and 174' in the heated spray retarder blocks 170 and 171, the mist streams will have a temperature ranging from 50° to 80° C. The termperature of the mist depositing on the container 13 will range from 60° to 70° C. The foregoing operational description of the sterilizing section **16*c*** stands on the assumption that each spray nozzle has expelled the stream of the dispersed sterilizing liquid under air pressure of four kilograms per square centimeter ($kg/cm^2$) and at a flow rate of 35 liters per minute (1/min).

The threaded rods 172 and 172', together with the nuts 173 and 173' thereon, permit the spray retarder blocks 170 and 171 to be adjustably moved toward and away from the top wall **150*a* of the upper wall assembly 38*c* and the bottom wall 151*a* of the lower wall assembly 40c, respectively. In other words, the widths of the air passages 179 and 179' are adjustably variable to control the flow rates of the air flowing from these passages into the spray channels 174 and 174' in the spray retarder blocks 170 and 171. Such air streams serve to reduce turbulence in the vicinities of the spray nozzles 42c and 43c** and thus to minimize mist attachment thereto.

The greater the widths of the air passages 179 and 179', the higher will be the velocities of the sprays. The spray velocities are thus adjustable anywhere, for example, one and three meters (m) per sec. The high velocity sprays are suitable for application to large containers, and the low velocity sprays for application to small containers. Were it not for the spray retarder blocks 170 and 171, the spray velocities would be as high as 10 m/sec.

The other constructional and operational details of this sterilizing section 16c are identical with those of the embodiment of FIGS. 3 and 4 and that of FIG. 7.

FIG. 9 illustrates the adaptation of the spray retarder blocks 170 and 171 for use in the sterilizing section of the type shown in FIG. 6. While the illustrated spray retarder block 170a is assumed to be the upper one, it is apparent that the lower block can be of like configuration, except that the latter is to be mounted upside down.

The spray retarder block 170a has formed therein a plurality of spray channels 174a arranged in a row, such channels being divided from each other by partitions 185. Also formed in the spray retarder block 170a are a pair of air chambers 176a open to the opposite sides of each spray channel 174a. A heater or heaters 180a are mounted within the spray retarder block 170a for heating same. Several hanger bolts or threaded rods 172a are used for suspending the block from the top wall of the upper sterilizing chamber. The sprays of the sterilizing liquid are to be directed into and through the respective spray channels 174a from the series of phantom spray nozzles that are designated 42a by reason of close association of this spray retarder block 170a with the sterilizing section 16a of FIG. 6.

While the flow rates of the air drawn into the spray channels are controlled by moving the flow retarder blocks toward and away from the top and bottom walls of the sterilizing chambers in the embodiments of FIGS. 8 and 9, the same purpose can be accomplished by providing valves in the air passages. The arrangement of FIG. 10 embodies this alternative.

The reference numeral 190 in FIG. 10 generally designates the valve mechanism for manual adjustment of the flow rate of the air to be drawn into each spray channel. Each valve mechanism 190 includes a valve member 191 in the form of an elongated, rectangular plate, which is at least partly received in a groove 192 formed in, for example, the top wall 150b of the upper sterilizing chamber.

The valve member 191 is slidable up and down in the groove 192 to vary the flow rate of air through the passage between the top wall 150b and a spray retarder block 170b. Threaded rods or hanger bolts 193, each connected at one end to the valve member 191 and extending upwardly through the top wall 150b, permit the valve member to be adjustably moved to and retained in a desired position by turning nuts 194 thereon. The valve mechanisms 190 lend themselves for use both with the spray retarder blocks 170 and 171 of FIG. 8 and with the spray retarder block 170a of FIG. 9.

Figures 11, 12:
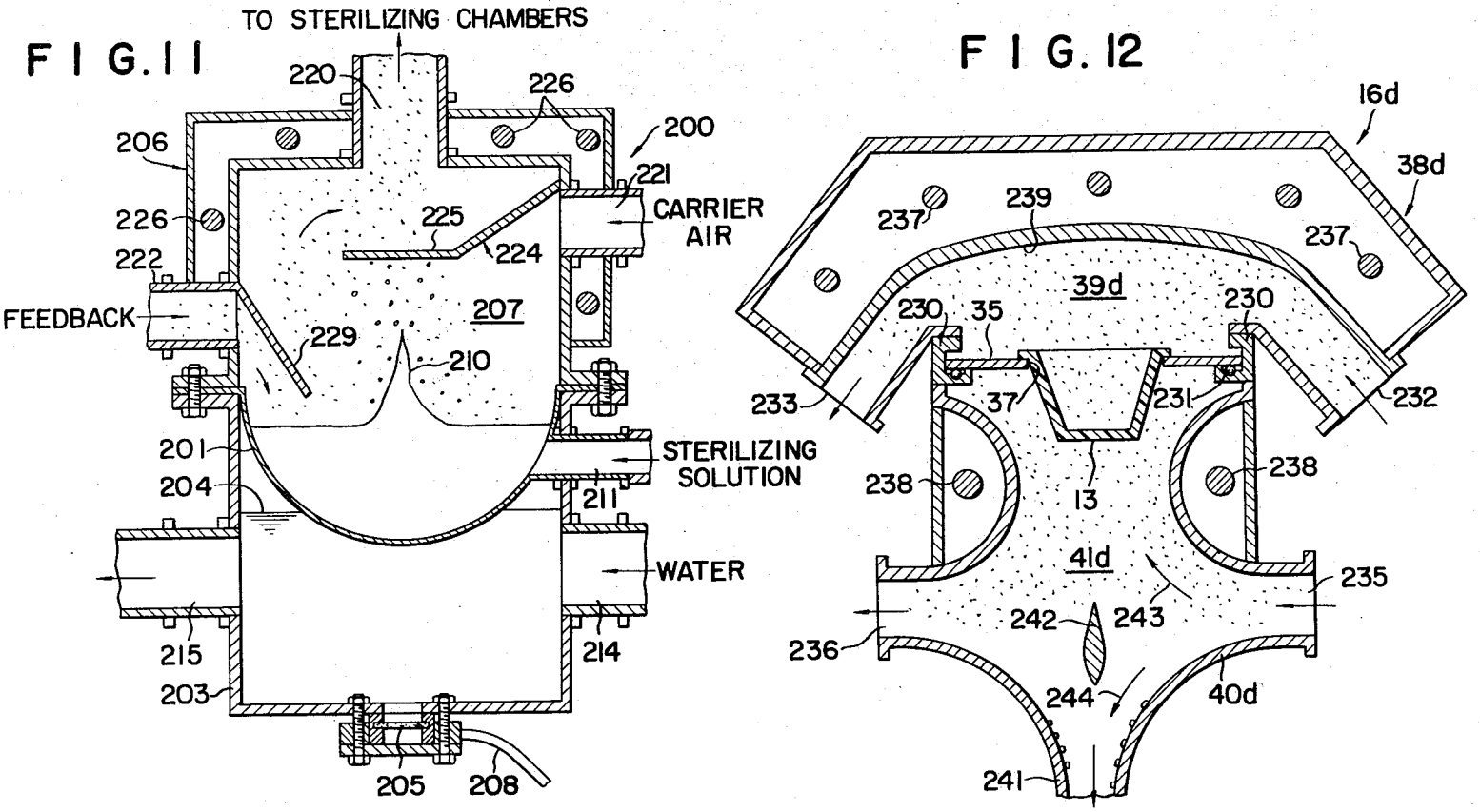
FIG. 11 is a vertical sectional view of an ultrasonic atomizing section for creating the mist of a sterilizing liquid to be delivered to a correspondingly modified sterilizing section in the apparatus of FIG. 1.
FIG. 12 is a vertical sectional view of the modified sterilizing section for receiving the mist of the sterilizing liquid from the ultrasonic atomizing section of FIG. 11.
Figure 13:
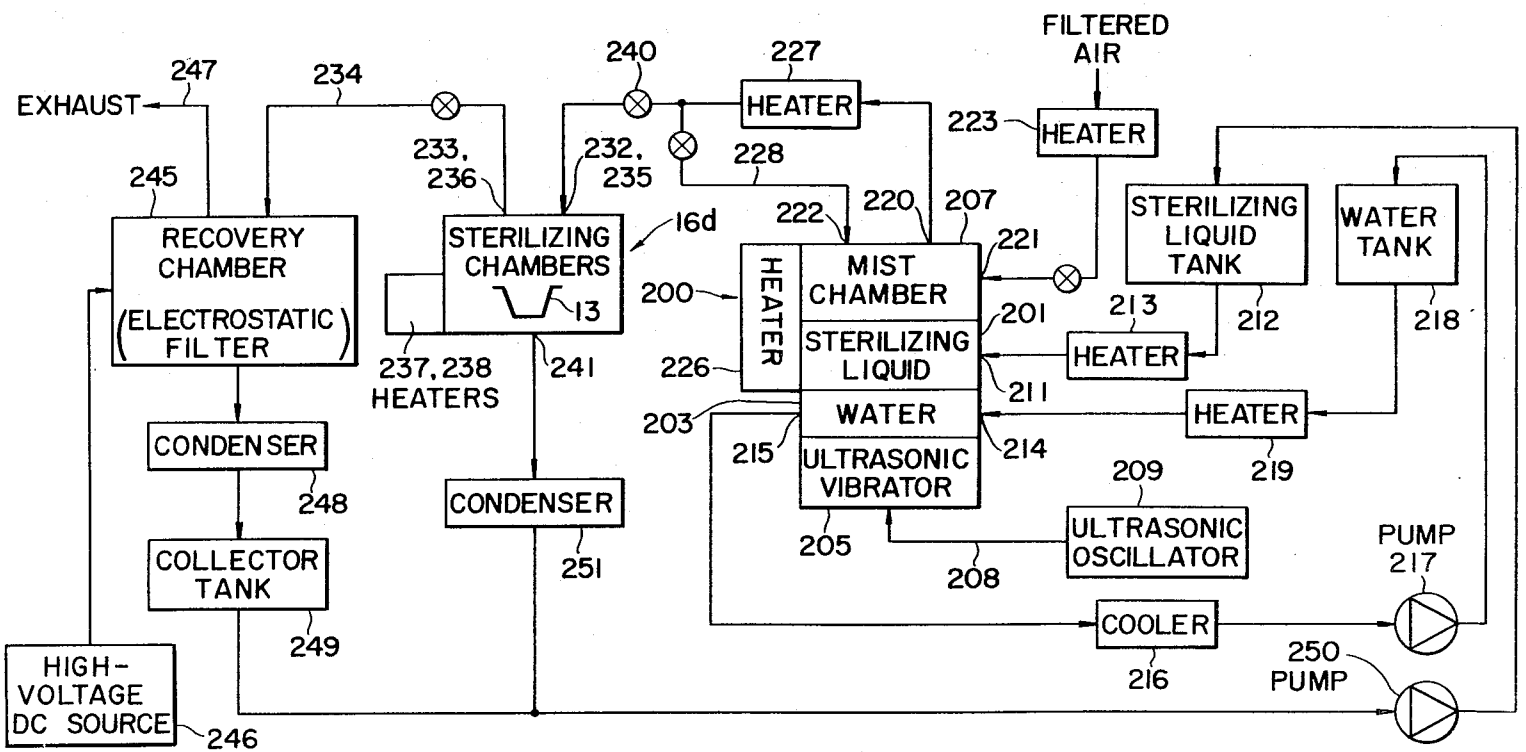
FIG. 13 is a flow chart of the system including the ultrasonic atomizing section of FIG. 11 and the sterilizing section of FIG. 12.

Embodiments of FIGS. 11–13

While all the preceding embodiments employ spray nozzles for application of a sterilizing agent to containers, the use of ultrasonic atomizers affords the creation of smaller, more uniform droplets. FIG. 11 shows an example of ultrasonic atomizing section 200, in which the sterilizing liquid is ultrasonically subdivided into fine droplets or mist for delivery to a correspondingly modified sterilizing section 16d given in FIG. 12.

The sterilizing section 16d is to replace the sterilizing section 16 in the food packaging system of FIG. 1. Preferably the ultrasonic atomizing section 200 is disposed exteriorly of the enclosure 10 (FIG. 1) for the ease of inspection and maintenance. Given below is the description of the ultrasonic atomizing section 200, with reference directed also to the flow chart of FIG. 13, followed by that of the sterilizing section 16d.

The principal constituents of the ultrasonic atomizing section 200 are:

(1) a resonator vessel or bowl 201 containing the sterilizing liquid to be atomized;

(2) another vessel 203 underlying the sterilizing liquid vessel 201 and containing purified and heated water 204;

(3) an ultrasonic vibrator 205 mounted at the bottom of the water vessel 203 and capable of vibrating at an ultrasonic frequency; and (4) a wall assembly 206 bolted to the water vessel 203 and defining a mist chamber 207 over and in direct communication with the sterilizing liquid vessel 201.

The ultrasonic vibrator 205 is connected through coaxial cable 208 to an ultrasonic oscillator circuit 209 (FIG. 13) which generates an ultrasonic frequency of, say, 1.0 to 2.0 megahertz (MHz). Vibrating at any selected ultrasonic frequency in the noted range, the vibrator 205 imparts the ultrasonic waves to the resonator vessel 201 through the medium of water 204. The sterilizing agent in the resonator vessel 201, which may be any of hydrogen peroxide solution, alcohol or chlorine water as aforesaid, will attack the ultrasonic vibrator 205 if placed in direct contact therewith. This is avoided by employing water for transmission of the ultrasonic waves from the vibrator 205 to the resonator vessel 201, the latter being at least partly immersed in the water 204 in the vessel 203.

Molded from plastics, metal or like materials, the resonator vessel 201 is thin and hemispherical in shape. The resonator vessel 201 resonates in response to the ultrasonic vibrations of the vibrator 205, creating a rising spout 210 of the sterilizing liquid contained therein. This spout further sends forth extremely fine mist or droplets, which are largely of uniform size ranging from about 20 to 50 microns. The hemispherical shape of the resonator vessel 201 serves to converge the ultrasonic vibrations at the spout 210 and hence to enhance the efficiency of atomization.

The reasonator vessel 201 has an inlet 211 for receiving the sterilizing liquid. FIG. 13 shows at 212 a tank containing a supply of the sterilizing liquid, for delivery to the resonator vessel 201 through a heater 213.

The water 204 in the vessel 203 should be free from contaminants for effective transmission of ultrasonic waves therethrough. As will be seen from both FIGS. 11 and 13, the water constantly recirculates through the path comprising vessel inlet 214, vessel outlet 215, cooler 216, pump 217, tank 218, and heater 219. Such constant recirculation is necessary to keep the water at an unvarying temperature within the vessel 203 in spite of the heat transmitted from the heated sterilizing solution through resonator vessel 201 and of the heat emitted by the ultrasonic vibrator 205. The temperature of the water in the vessel 203 should preferably be about 60° C., at which pure water transmits ultrasonic vibrations with utmost efficiency.

The wall assembly 206 defining the mist chamber 207 has a mist outlet 220 for delivering the ultrasonically created mist of the sterilizing liquid to the sterilizing section 16*d* (FIG. 12), an air inlet 221 for receiving filtered and heated carrier air, and a mist inlet 222 through which a portion of the outgoing mist is fed back into the mist chamber 207.

Heated by a heater 223 (FIG. 13), the stream of carrier air enters the mist chamber 207 through the air inlet 221 and carries the mist away from the chamber through the mist outlet 220. The temperature of the incoming carrier air can be from about 50° to 100° C. The carrier air should not carry larger drops of the sterilizing liquid away from the mist chamber 207. To this end, a baffle plate 224 intrudes between resonator vessel 201 and mist outlet 220. The horizontal portion 225 of the baffle plate 224, immediately overlying the spout 210 of the sterilizing liquid, prevents the larger drops from rising into the mist outlet 220.

The wall assembly 206 is mostly of double wall construction and has a built-in heater 226 for constantly heating the rising stream of mist. The heater 226 may heat the mist chamber 207 to a temperature range of 50° to 80° C.

The airborne stream of mist that has left the mist chamber 207 is further heated by a heater 227 (FIG. 13) on its way to the sterilizing section 16*d*. FIG. 13 also shows a feedback path 228 for returning a portion of the mist stream to the mist chamber 207 through its mist inlet 222. A baffle plate 229 directs the returning mist downwardly and shields the mist inlet 222 from the carrier air forced into the mist chamber 207 through the air inlet 221. By thus feeding back the mist stream, still finer mist can be delivered to the sterilizing section 16*d*. The mist particles introduced into the sterilizing section will have a nearly constant diameter of, say, 20 microns. The heater 227 maintains the mist stream in the temperature range of 50° to 80° C.

Reference is now directed to FIG. 12 to describe the construction of the sterilizing section 16*d* for use with the ultrasonic atomizing section 200. The sterilizing section 16*d* comprises an upper wall assembly 38*d* defining an upper sterilizing chamber 39*d* over the span of the container transport conveyor 12, and a lower wall assembly 40*d* defining a lower sterilizing chamber 41*d* under the conveyor upper span.

A pair of guide rails 230 extend horizontally between the upper 38*d* and the lower 40*d* wall assemblies for guiding the endless series of container carrier plates 35 of the conveyor 12. Each guide rail 230 has a series of balls or rolls 231 for rolling engagement with the container carrier plates 35. Closely fitted between the upper 38*d* and the lower 40*d* wall assemblies, the guide rails 230 coact therewith to define the hermetically sealed upper 39*d* and lower 41*d* sterilizing chambers.

The upper sterilizing chamber 39*d* has a mist inlet 232 in communication with the mist chamber 207 of the ultrasonic atomizing section 200, and a mist outlet 233 in communication with an exhaust line 234 of FIG. 13. The lower sterilizing chamber 41*d* likewise has a mist inlet 235 in communication with the atomizing section mist chamber 207, and a mist outlet 236 in communication with the exhaust line 234.

Thus, borne by the heated carrier air, the mist of the sterilizing liquid from the ultrasonic atomizing section 200 enters the upper and lower sterilizing chambers 39*d* and 41*d* through their mist inlets 232 and 235. Part of the incoming mist deposits on the surfaces of the successive containers 13 on the conveyor 12 as thin, uniform films. Excess amounts of the mist are exhausted through the mist outlets 233 and 236.

The mist particles floating in or flowing through the sterilizing chambers 39*d* and 41*d* should be maintained at the noted diameter of 20 microns or so. For the attainment of this objective the upper and lower wall assemblies 38*d* and 40*d* have heaters mounted at 237 and 238, respectively, for heating the chambers 39*d* and 41*d*. The provision of the heater 237 to the upper wall assembly 38*d* is recommended, whereas the heater 238 of the lower wall assembly 40*d* is rather optional.

If the sterilizing agent in use is a 35% hydrogen peroxide solution, the temperature of the mist around the container 13 should be kept in a temperature range of 50° to 80° C., preferably about 60° C., by the heater 237 or by the heaters 237 and 238 in order to maintain the mist particles at the minimal size. The heaters 237 and 238 serve also to gasify the mist particles on the inside surfaces of the wall assemblies 38*d* and 40*d*. Hydrogen peroxide solutions gasify at 80° to 100° C.

Experiment has proved that the sterilizing ability of hydrogen peroxide solutions diminishes on gasification. The part of the mist immediately surrounding the container 13 should therefore be heated only to such a temperature range (50° to 80° C.) that the diameters of its particles remain at about 20 microns. In the other regions of the sterilizing chambers 39*d* and 41*d* the mist can be heated to its gasifying temperatures (80° to 100° C.). The gasification of the unused mist is desirable because otherwise such mist might condense into large drops and stream down to or fall onto the container 13.

In spite of the provision of the heater 237 in the upper wall assembly 38*d*, large drops of the sterilizing solution may form on its inside surfaces. The ceiling or top 239 of the upper wall assembly 38*d* is arched in consideration of this possibility, in order that the drops may not fall onto the container 13.

It will be recalled that the succession of containers 13 are fed intermittently by the conveyor 12 through the processing space 11 of the food packaging system shown in FIG. 1. The ultrasonic atomizing section 200 of FIG. 11, on the other hand, constantly creates and supplies the mist of the sterilizing liquid. Being of such fine and uniform particles, the mist will not deposit on the successive containers 13 to any excessive degree if admitted continuously into the sterilizing chambers 39*d* and 41*d*.

As required or desired, however, an on-off valve 240 may be provided as in FIG. 13 between heater 227 and sterilizing section 16*d*, for introducing the mist stream into the sterilizing chambers 39*d* and 41*d* only while the successive containers 13 are being held at rest therebetween. The valve 240 may be solenoid operated, by utilizing the electrical signal explained in connection with FIG. 3. Such intermittent introduction of the mist stream into the sterilizing chambers allows more economic use of the mist.

FIG. 12 further shows that the lower wall assembly 40*d* has formed therein a drain outlet 241 for carrying off large drops of the sterilizing liquid that may collect on its inside surfaces. An airfoil-shaped baffle 242 lies immediately over the drain outlet 241 for dividing the incoming mist into an upward stream 243 and a downward stream 244. The upward mist stream 243 impinges on the container 13, whereas the downward mist stream 244, cooled by the wall surfaces bounding the drain outlet 241, condenses in part into large drops for drainage.

Any unused mist that has left the sterilizing chambers 39*d* and 41*d* through their mist outlets 233 and 236 travels through the exhaust line 234 to a recovery chamber 245 shown in FIG. 13. This recovery chamber has, for example, an electrostatic filter (not shown) of any known or suitable make which is energized by a high-voltage DC source 246 for separating the mist or droplets of the sterilizing liquid from the carrier air. The recovery chamber 245 sends out the carrier air, as well as the unrecoverable gas of the sterilizing liquid, to an exhaust line 247.

The recovered droplets of the sterilizing liquid, on the other hand, are condensed into bulk form by a condenser 248 and then temporarily stored in a collector tank 249. A pump 250 operates as required to return the recovered sterilizing liquid to the main tank 212. Instead of the mentioned electrostatic filter in the recovery chamber 245, means may be adopted for recovering the sterilizing liquid by causing mist condensation through a temperature drop.

The drain outlet 241 of the lower wall assembly 40*d* communicates with another condenser 251. The sterilizing liquid recovered by this condenser 251 is also returned to the main tank 212 by the pump 250.

Figure 14:
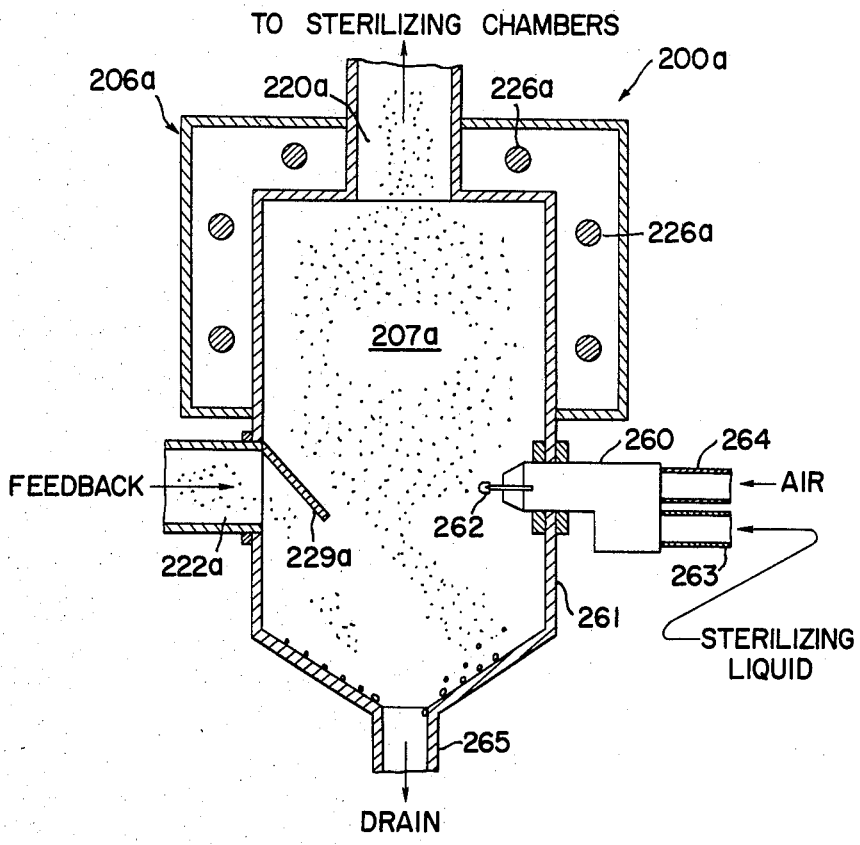
FIG. 14 is a vertical sectional view of a modified ultrasonic atomizing section for use with the sterilizing section of FIG. 12.
Figure 15:
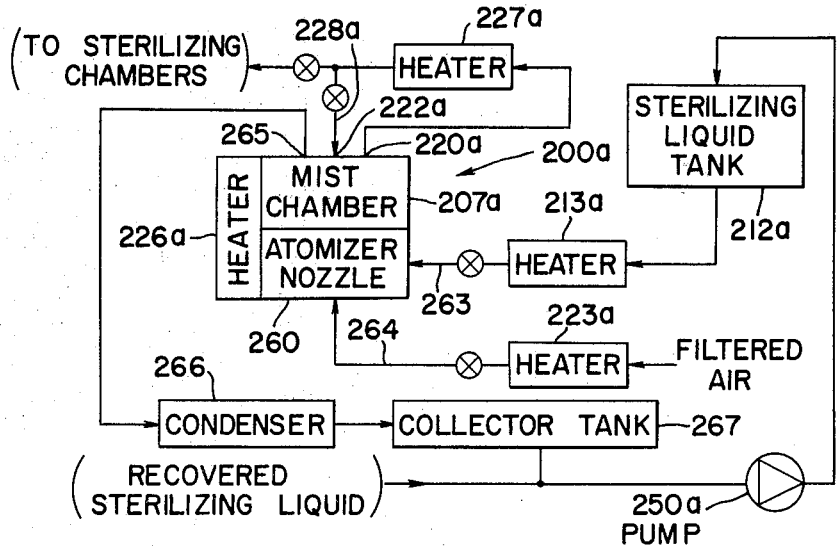
FIG. 15 is a flow chart of the system including the ultrasonic atomizing section of FIG. 14.

Embodiment of FIGS. 14 and 15

FIG. 14 illustrates a modified ultrasonic atomizing section 200*a*, for use with the sterilizing section 16*d* of FIG. 12. The modified atomizing section 200*a* employs an ultrasonic atomizer nozzle 260 in place of the ultrasonic vibrator 205, ultrasonic oscillator 209, etc., in the embodiment of FIGS. 11 and 13. The atomizer nozzle 260 is mounted on a side wall 261 of a wall assembly 206*a* defining a mist chamber 207*a*, with the nozzel partly projecting into the mist chamber.

As is well known, the ultrasonic atomizer nozzle 260 is such that liquid and gas streams expelled under pressure therefrom impinge on a resonator 262 mounted just in front of the nozzle opening. The thus impinged resonator 262 generates intense ultrasonic waves at, for example, 30 KHz thereby atomizing the liquid. In the present invention the sterilizing liquid and filtered and heated air are discharged from the atomizer nozzle 260 against the resonator 262. The atomizer nozzle 260 receives the sterilizing liquid through a conduit 263 and the air through a conduit 264. The droplets created by the atomizer nozzle 260 will average 10 microns in diameter.

The airborne droplets or mist of the sterilizing liquid rises through the mist chamber 207*a* and enters a mist outlet 220*a* formed in the top of the wall assembly 206*a*. Surrounding the upper portion of the mist chamber 207*a*, a heater 226*a* heats the rising stream of mist.

The wall assembly 206*a* has further formed in its bottom a drain outlet 265 similar to the drain outlet 241 (FIG. 12) of the lower sterilizing chamber 41*d* of the sterilizing section 16*d*. A feedback inlet 222*a* is also formed in the wall assembly 206*a* in opposed relationship to the atomizer nozzle 260. A baffle plate 229*a* overhanging the feedback inlet 222*a* shields this inlet against the entrance of the mist just created by the atomizer nozzle 260.

Given in FIG. 15 is a flow chart of the system including the ultrasonic atomizing section 200*a* of FIG. 14. A heater 227*a* heats the airborne mist stream traveling toward the sterilizing chambers 39*d* and 41*d* (FIG. 12) of the sterilizing section 16*d*. Part of the mist stream returns to the mist chamber 207*a* by way of a feedback path 228*a*. The atomizer nozzle 260 receives the sterilizing liquid from a tank 212*a* through a heater 213*a* and receives the clean, heated air through a heater 223*a*.

The drain outlet 265 of the mist chamber 207*a* communicates with a condenser 266, where the sterilizing liquid is recovered in bulk form. After being temporarily stored in a collector tank 267, the recovered sterilizing liquid is fed back into the tank 212*a* by a pump 250*a*. Reference back to FIG. 13 will show that the pump 250*a* also operates to return to the tank 212*a* the sterilizing liquid that has been recovered from the sterilizing chambers 39*d* and 41*d*.

Figure 16:
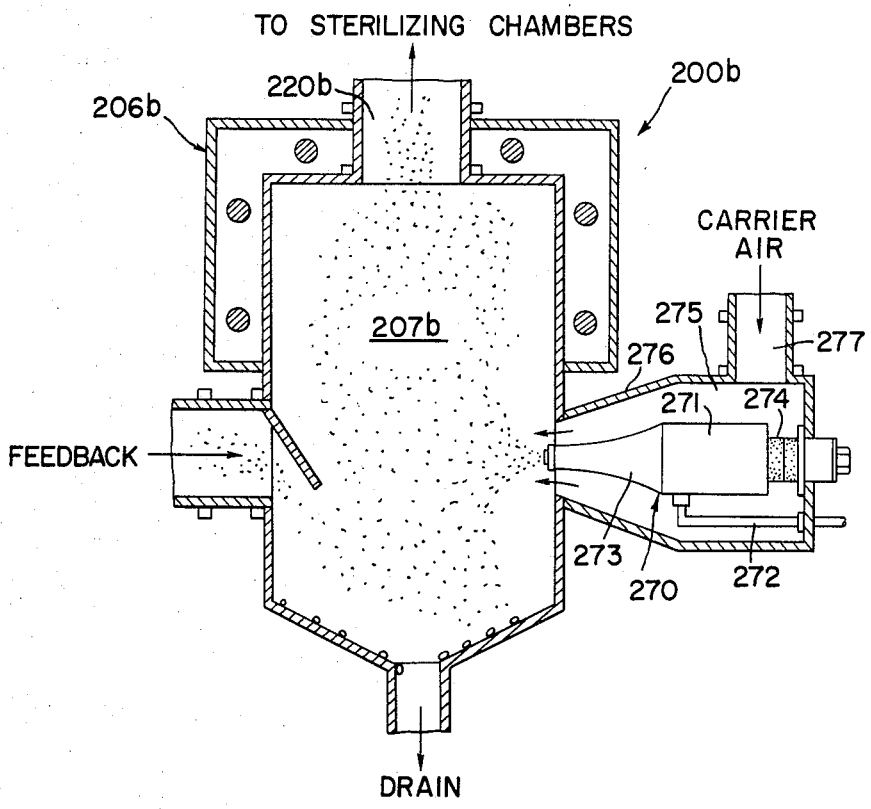
FIG. 16 is a vertical sectional view of another modified ultrasonic atomizing section for use with the sterilizing section of FIG. 12.
Figure 17:
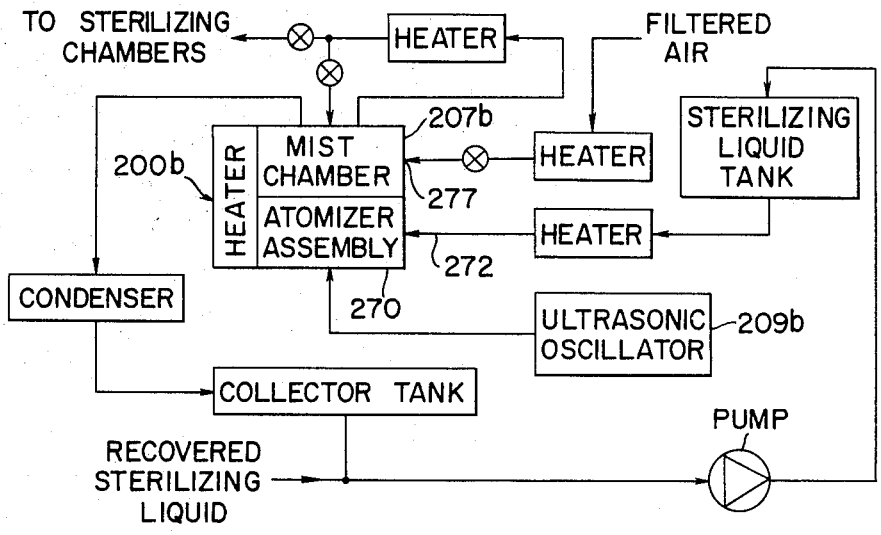
FIG. 17 is a flow chart of the system including the ultrasonic atomizing section of FIG. 16.

Embodiment of FIGS. 16 and 17

FIG. 16 shows another modified ultrasonic atomizing section 200*b*, also for use with the sterilizing section 16*d* of FIG. 12. This atomizing section 200*b* features an ultrasonic atomizer assembly 270 which is itself well known in the art and which operates on a principle different from that of the ultrasonic atomizer nozzle 260 in FIG. 14. The atomizer assembly 270 comprises:

(1) a body 271 into which the sterilizing liquid is supplied through a conduit 272;

(2) a nozzle 273 projecting forwardly from the body 271 and open to a mist chamber 207*b* defined by a wall assembly 206*b*; and (3) an ultrasonic vibrator unit 274 mounted on the back of the body 271 and excited from an ultrasonic oscillator circuit 209*b* seen in FIG. 17.

Vibrating at an ultrasonic frequency which may range from 30 to 100 KHz, the ultrasonic vibrator unit 274 of the atomizer assembly 270 causes atomization of the sterilizing liquid fed into the atomizer body 271. The atomized liquid is expelled into the mist chamber 207*b* from the atomizer nozzle 273. The mist particles will have diameters ranging from 20 to 50 microns.

The atomizer assembly 270 is mounted in an air chamber 275 defined by an enclosure 276 connected to the wall assembly 206*b*. The air chamber 275 is in constant communication with the mist chamber 207*b*. The enclosure 276 has an air inlet 277 for receiving clean, heated air under pressure. Fed into the mist chamber 207*b* from the air chamber 275, this air carries the mist of the sterilizing liquid away into the mist outlet 220*b*. The carrier air flowing through the air chamber 275 serves to protect the vibrator unit 274 from the attack by the mist. The other structural and operational details of this atomizing section 200*b* are identical with those set forth in connection with the atomizing section 200*a* of FIG. 14.

FIG. 17 is a flow chart of the system incorporating the atomizing section 200*b* of FIG. 16. It will be readily seen that that this system is analogous with that of FIG. 15, except for the method of utilizing the carrier air.

Embodiments of FIGS. 18–24

Figure 18:
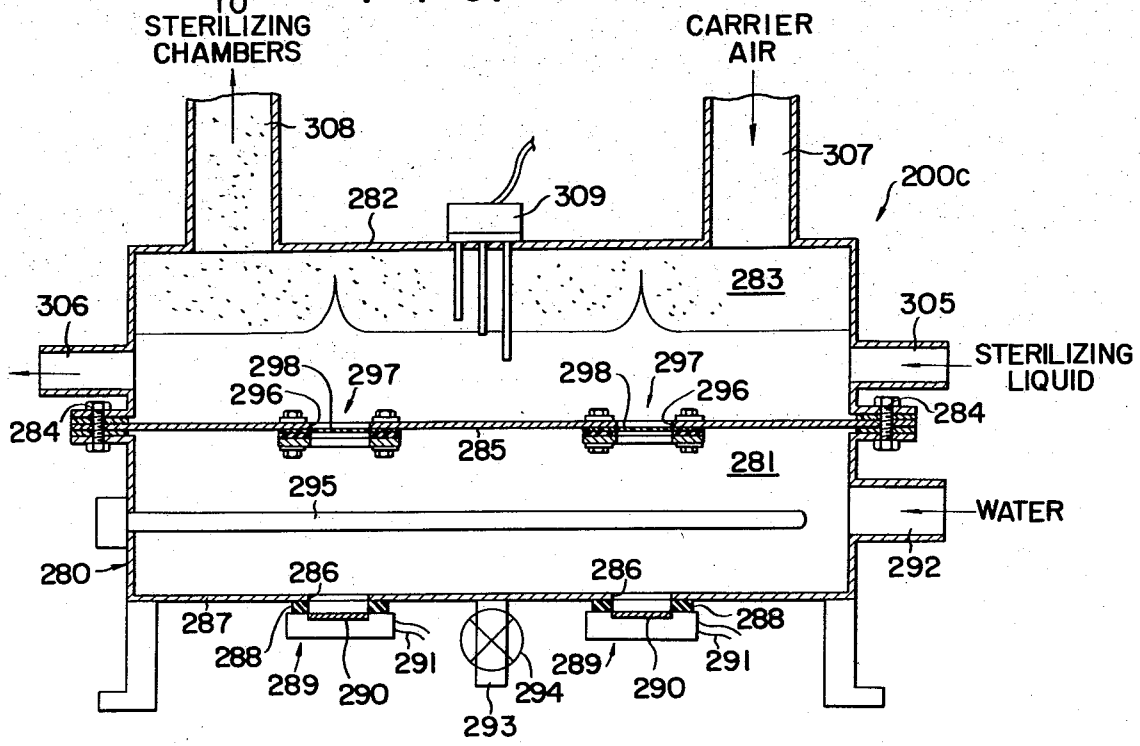
FIG. 18 is a vertical sectional view of a further modified ultrasonic atomizing section for use with the sterilizing section of FIG. 12.

FIG. 18 gives a further modified ultrasonic atomizing section 200*c* for use with the sterilizing section 16*d* of FIG. 12. This atomizing section 200*c* is similar in principle to the atomizing section 200 of FIG. 11 but differs therefrom in that the section 200*c* is capable of simultaneously producing several rising spouts of the sterilizing liquid for more efficient atomization.

The atomizing section 200*c* comprises a lower wall assembly 280 defining a water chamber 281 therein, and an upper wall assembly 282 defining an atomizing chamber 283 therein. The upper wall assembly 282 is mounted on top of the lower wall assembly 280 and liquid-tightly connected thereto as by bolts 284. A partition 285, as of stainless steel, separates the water chamber 281 and the atomizing chamber 283 from each other. The water chamber 281 is filled up with water, whereas the atomizing chamber 283 is only partly filled with the sterilizing solution.

At least one, preferably two or more, circular openings 286 are formed in the bottom 287 of the lower wall assembly 280. Under each opening there is watertightly mounted, through a rubber packing 288, an ultrasonic vibrator assembly 289 including an ultrasonic vibrator 290. The ultrasonic vibrator assemblies 289 are electrically connected to an ultrasonic oscillator circuit 209*c* (FIG. 19) through cables 291.

The lower wall assembly 280 has a water inlet 292 and a drain 293 having a valve 294. A heater 295 is mounted in the water chamber 281 for heating the water. Thus the ultrasonic vibrations of the vibrators 290 propagate through the heated water in the water chamber 281.

The partition 285 has circular openings 296 formed therein in vertical register with the openings 286 in the bottom 287 of the lower wall assembly 280. These openings 296 are liquid-tightly closed by resonator film assemblies 297 shown in detail in FIGS. 20 and 21. Each resonator film assembly 297 comprises a thin, disclike film 298 placed under the partition 285 so as to cover one of the openings 296, an annular packing 299 underlying the resonator film 298, and a retainer ring 300 of stainless steel underlying the packing 299. The resonator film 298, packing 299 and ring 300 are fastened to the partition 285 by bolts 301, washers 302 and 303, and nuts 304.

The resonator films 298 of the film assemblies 297 should be fabricated from plastics or like material capable of resonating in response to the ultrasonic waves sent forth by the ultrasonic vibrators 290 through the water contained in the water chamber 281. Polystyrene is a particularly preferred material of the resonator films 298. Each resonator film 298 can be from 0.1 to 1.0 mm thick.

Figure 22:
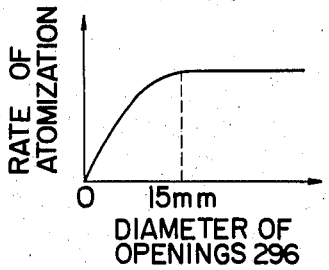
FIG. 22 is a graphic representation of the relationship between the diameter of each of the openings closed by the resonator film assemblies and the rate of atomization of the sterilizing liquid in the ultrasonic atomizing section of FIG. 18.
Figure 21:
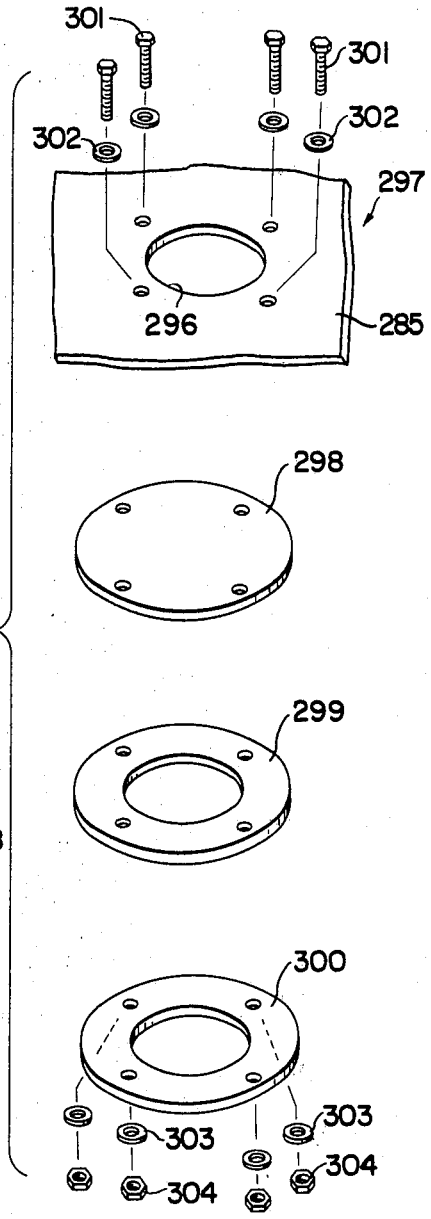
FIG. 21 is an exploded perspective view of the resonator film assembly of FIG. 20.

For most efficient atomization of the sterilizing liquid the diameter of each opening 296 closed by the resonator film 298 should be at least about 15 mm. FIG. 22 graphically represents the relationship between the diameter of each opening 296 and the rate of atomization of the sterilizing liquid, specifically, hydrogen peroxide solution. It will be observed that the atomization rate increases almost in proportion to the increase in the diameter of the opening 296 until the diameter becomes 15 mm, and then levels off. The resonator films 298 will be easily mounted in position without wrinkles or slacks, and will permit ready replacement when worn or damaged, if the opening diameter is from about 15 to 30 mm.

Figure 23:
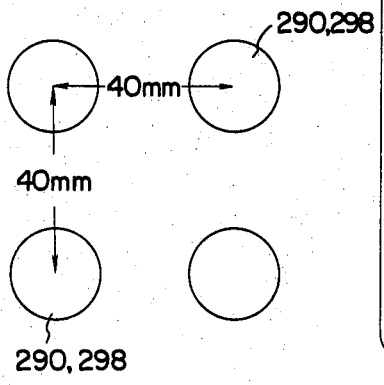
FIG. 23 is a diagram explanatory of the arrangement of, and spacings between, the resonator film assemblies and associated ultrasonic vibrators in the ultrasonic atomizing section of FIG. 18.
Figure 24:
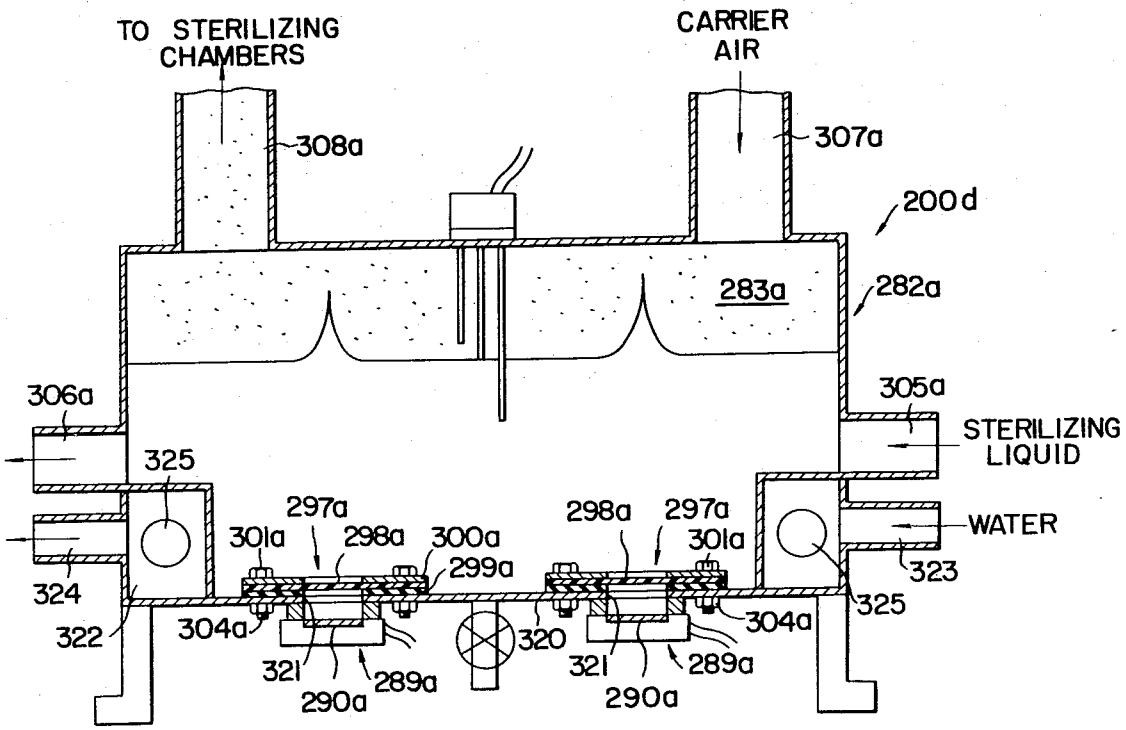
FIG. 24 is a vertical sectional view of a slight modification of the ultrasonic atomizing section of FIG. 18.

As has been mentioned, the provision of a plurality of ultrasonic vibrator assemblies 289, and of course the corresponding number of resonator film assemblies 298 is recommended to improve the production of this atomizing section 200*c*. This particular embodiment employs four ultrasonic vibrator assemblies 289 and four resonator film assemblies 298, which are arranged as schematically depicted in FIG. 23.

Experiment has shown that the center-to-center distance between any two adjacent vibrators 290, for example, should be at least about 40 mm, provided that the vibrators 290 are spaced about 20 mm from the partition 285 and that the level of the sterilizing liquid in the atomizing chamber 283 is 20 mm from the partition. The noted minimal spacing between the adjacent vibrators is necessary to prevent the mutual interference of the capillary waves generated thereby. With the above arrangement the rate at which the sterilizing liquid is atomized will become higher approximately in proportion to the number of the vibrators 290 and of the resonator film assemblies 297.

With reference back to FIGS. 18 and 19 the upper wall assembly 282 has a liquid inlet 305 and a liquid outlet 306 for circulation of the heated sterilizing liquid. Further the upper wall assembly 282 has an air inlet 307 for admitting filtered and heated carrier air under pressure into the atomizing chamber 283, and a mist outlet 308 for delivering the mist of the sterilizing liquid, borne by the carrier air, toward the sterilizing chambers 39*d* and 41*d* of FIG. 12.

Figure 19:
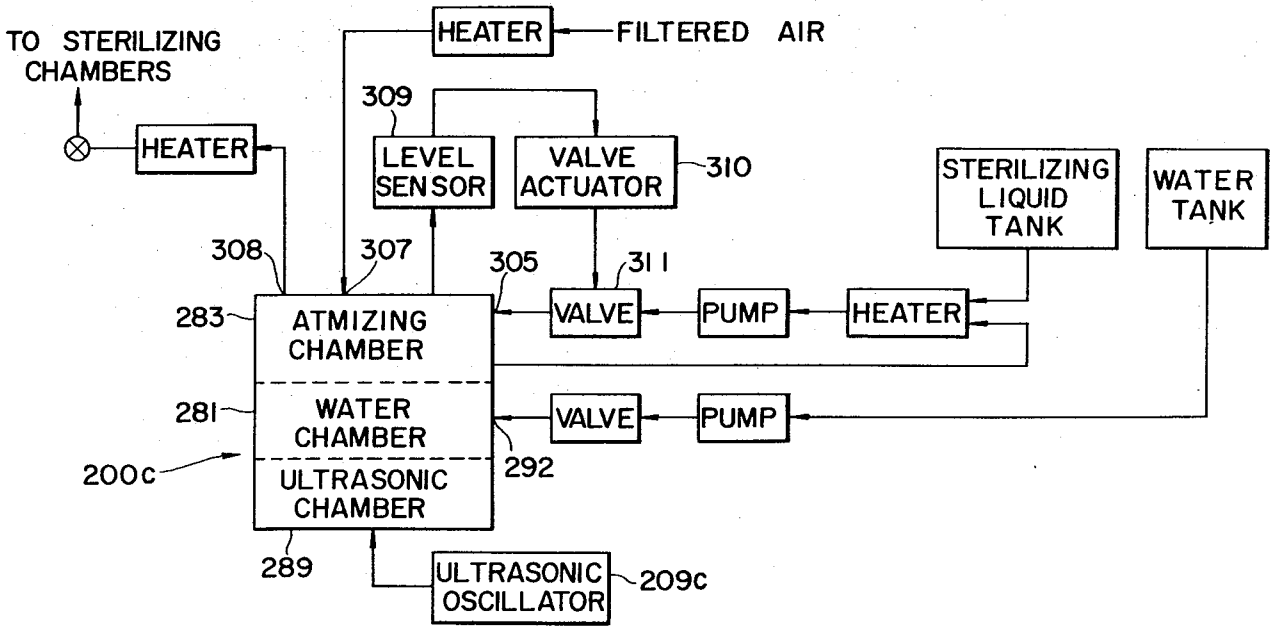
FIG. 19 is a flow chart of the system including the ultrasonic atomizing section of FIG. 18.
Figure 20:
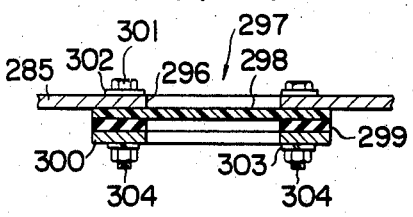
FIG. 20 is an enlarged, vertical sectional view of one of several identical resonator film assemblies used in the ultrasonic atomizing section of FIG. 18.

Shown at 309 in FIGS. 18 and 19 is a level sensor of known design capable of sensing the level of the sterilizing liquid in the atomizing chamber 283. The level sensor 309 is electrically connected to a valve actuator 310 capable of opening and closing an on-off valve 311 through which the sterilizing liquid is pumped into the atomizing chamber 283. The level sensor 309, valve actuator 310, and on-off valve 311 coact in a well known manner to maintain within preassigned limits the sterilizing liquid level in the atomizing chamber 283.

While the preceding embodiment employs water for the transmission of ultrasonic vibrations from the vibrators to the resonator films, such vibrations can likewise be transmitted through the medium of air. A still further modified ultrasonic atomizing section 200*d* shown in FIG. 24, also for use with the sterilizing section 16*d* of FIG. 12, is constructed on this latter principle.

The atomizing section 200*d* includes a wall assembly 282*a* defining therein an atomizing chamber 283*a* partly filled with the sterilizing liquid. The wall assembly 282*a* has a liquid inlet 305*a*, a liquid outlet 306*a*, a carrier air inlet 307*a*, and a mist outlet 308*a*. The functions of all these inlets and outlets will be apparent from the foregoing description of FIGS. 18 and 19.

The bottom 320 of the wall assembly 282*a* has at least one, preferably two or more, circular openings 321 formed therein. Under each opening 321 there is mounted an ultrasonic vibrator assembly 289*a* having a vibrator 290*a*. Further each opening 321 is liquid-tightly closed from above by a resonator film assembly 297*a* including a resonator film 298*a* sandwiched between packing 299*a* and retainer ring 300*a*. As in the preceeding embodiment each resonator film assembly 297*a* is fastened to the bottom 320 by bolts 301*a* and nuts 304*a*.

The lower portion of the atomizing chamber 283*a* is partitioned off into an annular water chamber 322 having a water inlet 323 and outlet 324. The water chamber 322 has a heater 325 mounted therein for heating the sterilizing liquid in the atomizing chamber 283*a* through the medium of water.

In this modified atomizing section 200*d*, too, the resonator films 298*a* serve to keep the ultrasonic vibrators 290*a* out of contact with the sterilizing liquid, besides acting to transmit the ultrasonic vibrations of the vibrators 290*a* to the sterilizing liquid and hence to atomize the same. A particular advantage of this embodiment resides in the fact that the sterilizing liquid is heated in the atomizing chamber 283*c*, without it being necessary to recirculate the liquid through an external heater as in the preceding embodiment. This feature permits reduction of bubble formation to a minimum.

All the foregoing ultrasonic atomizing sections 200, 200*a*, 200*b*, 200*c* and 200*d*, of FIGS. 11, 14, 16, 18 and 24, respectively, have been described as being intended for use with the sterilizing section 16*d* of FIG. 12, by way of example only. These atomizing sections find use, of course, with sterilizing sections in which a plurality of containers or other articles are sterilized simultaneously, as in the sterilizing section 16*a* of FIG. 6. It will also be apparent that all the above atomizing sections will offer greater advantages if employed in conjunction with apparatus in which articles to be sterilized are fed continuously, not intermittently as in the apparatus of FIG. 1.

Embodiments of FIGS. 25–30

In sterilizing containers or other articles by the various means set forth hereinabove, it is important that a proper amount of a sterilizing agent be applied to each container. The application of an insufficient amount results in insufficient sterilization, and the application of an excessive amount makes it difficult to dry the containers quickly in the subsequent drying section. The application of a correct amount, then, necessitates accurate measurement or detection of the actual quantity of the sterilizing agent being sprayed or otherwise applied to each container or each group of containers.

The optimum fulfillment of this necessity commands a choice from a wide variety of possible schemes. It has been found most practical and reliable to make such detection from the optoelectronically ascertained density of the subdivided sterilizing liquid in the immediate vicinity of the container or containers being sterilized. The thus obtained data find use either for controlling the amount of the liquid applied, for giving an alarm as required, for removing or rejecting any improperly sterilized containers, or for controlling or modifying the operations of the other sections of the food packaging system.

Figure 25:
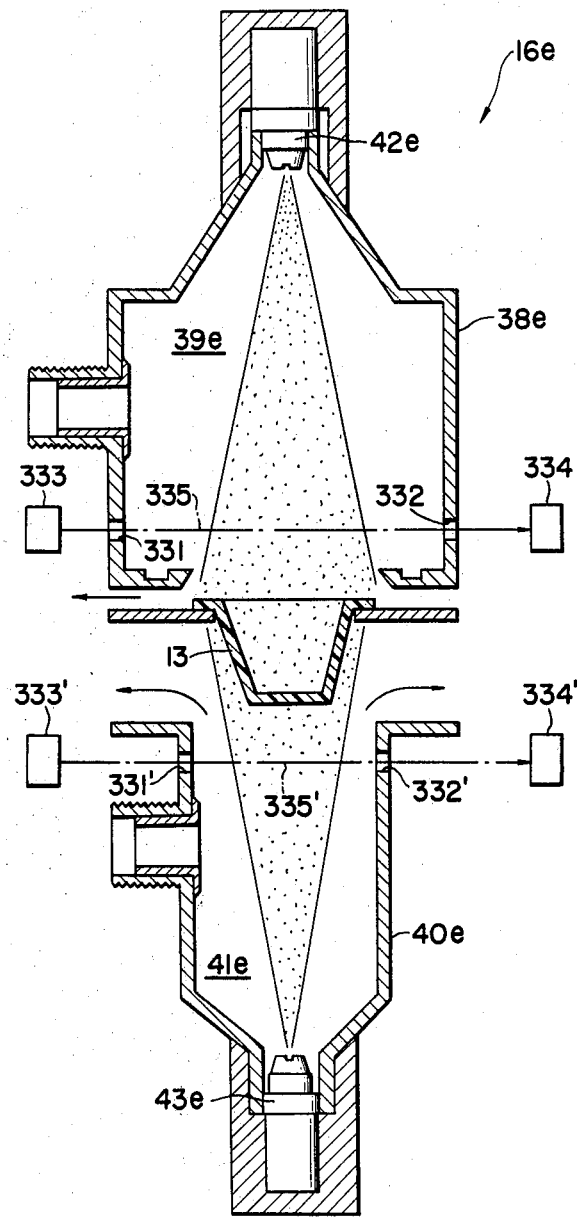
FIG. 25 is a view corresponding to FIG. 3 but showing the sterilizing section as modified to include means for sensing the densities of the sprays being applied to the successive containers.
Figure 26:
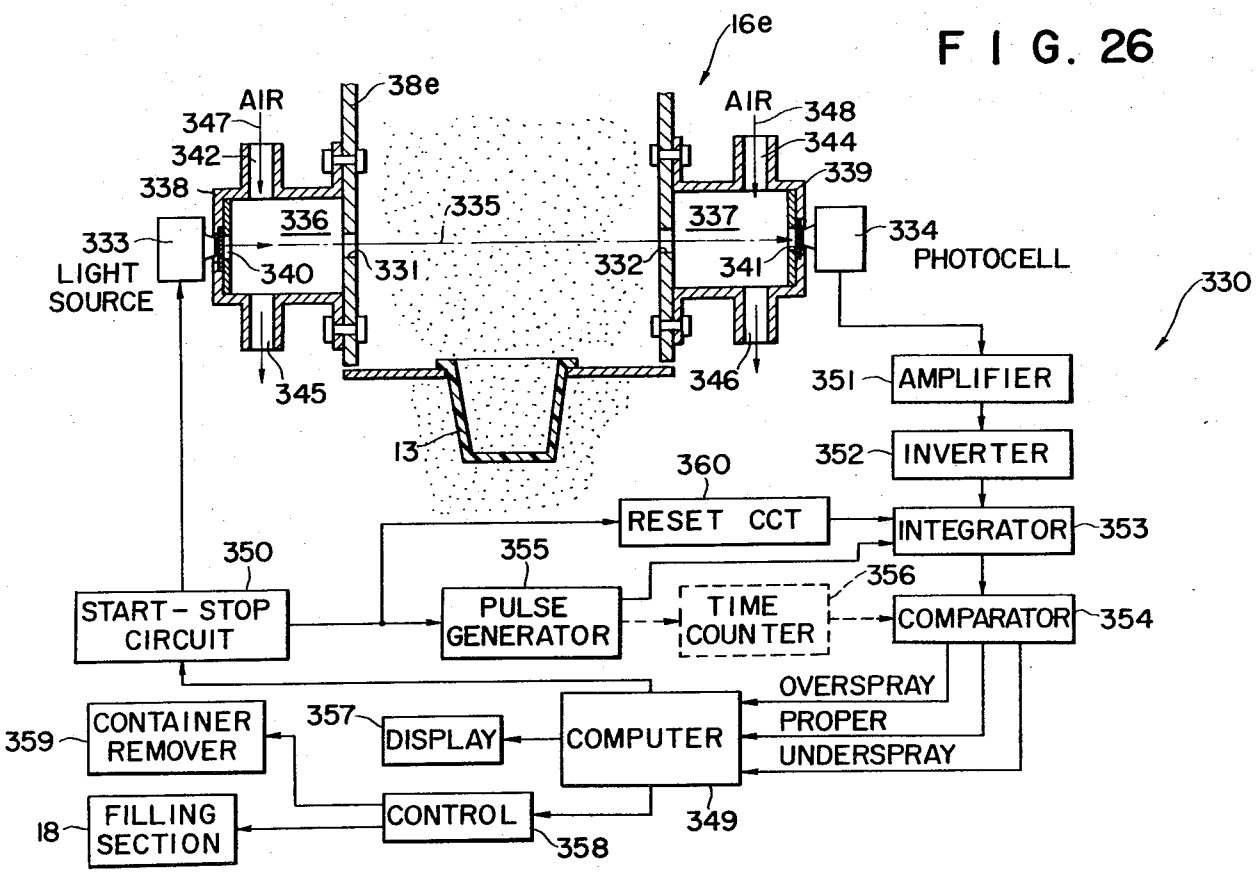
FIG. 26 is a fragmentary vertical sectional view showing in more detail the upper wall assembly and associated means of the modified sterilizing section of FIG. 25, the view also showing in block-schematic form the electronic circuitry for the detection of the spray densities.

FIGS. 25 and 26 represent one preferred system embodying the above concept, as incorporated in the sterilizing section 16 of FIG. 3 by way of example. In FIGS. 25 and 26 the sterilizing section including the spray or mist density detecting system is generally designated 16*e*, and the detecting system itself is generally labeled 330 in FIG. 26.

FIG. 25 is a schematic merely explanatory of the operating principle of the detecting system. Like all the preceding examples the sterilizing section 16*e* comprises an upper wall assembly 38*e* defining an upper sterilizing chamber 39*e*, and a lower wall assembly 40*e* defining a lower sterilizing chamber 41*e*. The upper wall assembly 38*e* has two apertures or windows 331 and 332 formed in its confronting side walls. A light source 333 and a light-sensitive element such as a photocell 334 are both disposed outside of the upper wall assembly 38*e* and in the vicinities of the respective apertures 331 and 332. A beam of light 335 emitted by the light source 333 passes through the apertures 331 and 332 and impinges on the photocell 334.

The lower wall assembly 40*e* also has two similar apertures 331' and 332' formed in its confronting side walls. A light beam 335' from a source 333' travels through the apertures 331' and 332' and falls on a photocell 334'.

As has been pointed out, this embodiment attempts to detect the amount of the subdivided sterilizing liquid depositing on each container 13 from the densities of the sprays expelled from the spray nozzles 42*e* and 43*e* (each identical with the one shown in FIG. 5). The arrangement of the light sources 333 and 333' and photocells 334 and 334', as well as of the apertures 331, 332, 331' and 332', should therefore be such that the light beams 335 and 335' traverse the respective sprays as close as possible to the container 13.

On passing through the sprays the light beams have their intensities diminished to variable degrees owing to reflection, refraction, etc., caused by the spray particles or droplets. Thus the intensities of the light falling on the photocells 334 and 334' are the measures of the spray densities and, consequently, of the amount of the sterilizing liquid droplets depositing on the container 13. As is well known, the photocells 334 and 334' produce electrical signals as functions of the incident radiant energies.

The problem occurs, however, that the spray densities increase with the lapse of time, as each container lying between the substantially closed sterilizing chambers is sprayed for a certain length of time. For this reason the measurement of the spray densities at one instant in time does not necessarily indicate the correct amount of the sterilizing liquid droplets depositing on each container.

The present embodiment overcomes the above problem by integrating the total spray density in each sterilizing chamber per unit length of time. The integral is then compared with a predetermined reference corresponding to the integral of the desired or correct total spray density during the unit length of time. The results of this comparison provide reliable indications as to the overspraying, underspraying, and proper spraying of each container.

FIG. 26 is a more detailed representation of the means for carrying the above outlined scheme into practice. Although this figure shows only the means for detecting the spray density in the upper sterilizing chamber 39*e*, it is understood that the spray density in the lower sterilizing chamber can be ascertained by exactly identical means. Alternatively the lower sterilizing chamber spray density may simply be estimated from the results of detection of the upper sterilizing chamber spray density.

Formed just outside of the apertures 331 and 332 in the upper wall assembly 38*e* of the sterilizing section 16*e* are small air chambers 336 and 337, respectively, which are defined by boxlike enclosures 338 and 339. These enclosures 338 and 339 have glazed windows 340 and 341, respectively, which are arranged in alignment with the apertures 331 and 332 in the upper wall assembly 38*e*. The light source 333 and photocell 334 are disposed outside of the glazed windows 340 and 341. Thus the light beam 335 emitted by the source 333 impinges on the photocell 334 after traveling through the window 340, aperture 331, aperture 332, and window 341, in that order.

The two air chambers 336 and 337 have it as an object to provide air curtains between apertures 331 and 332 and glazed windows 340 and 341 and hence to prevent mist attachment to the glass. To this end the air chambers 336 and 337 have respective slotlike air inlets 342 and 344 and air outlets 345 and 346. Streams 347 and 348 of filtered air under pressure enter the chambers 336 and 337 through the inlets 342 and 344 and leave the chambers through the outlets 345 and 346, respectively, thereby providing the desired air curtains.

Proceeding to the description of the electronic circuitry for the detection of spray densities, a computer 349 has one of its outputs connected to a start-stop circuit 350, which in turn has one of its outputs connected to the light source 333. When one of the successive containers 13 reaches the position between the upper and lower sterilizing chambers, the computer 349 (or the switch 114 of FIG. 3) causes the spray nozzles 42*e* and 43*e* to start spraying the sterilizing liquid onto the container. Simultaneously the start-stop circuit 350 under the control of the computer 349 causes the light source 333 to start emitting the light beam 335 across the spray from the upper spray nozzle 42*e*.

If desired, however, the light source 333 may be allowed to emit the light beam at all times, and a switch (not shown) may be closed to connect the photocell 334 to an amplifier 351 simultaneously with the start of spraying of each new container. Since the illustrated embodiment does not employ this alternative, the photocell 334 is shown directly connected to the amplifier 351.

Figure 27A:
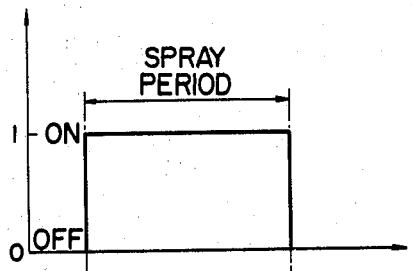
Figure 27B:
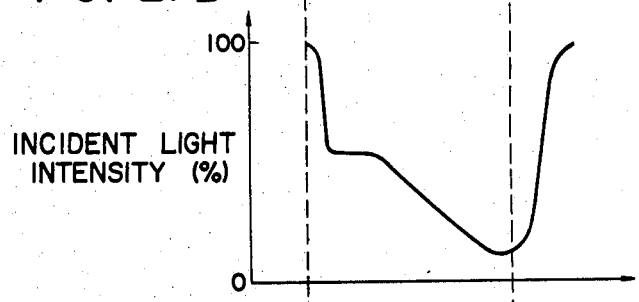
Figure 27C:
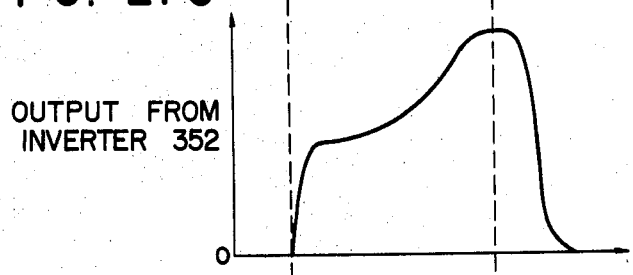
Figure 27C:
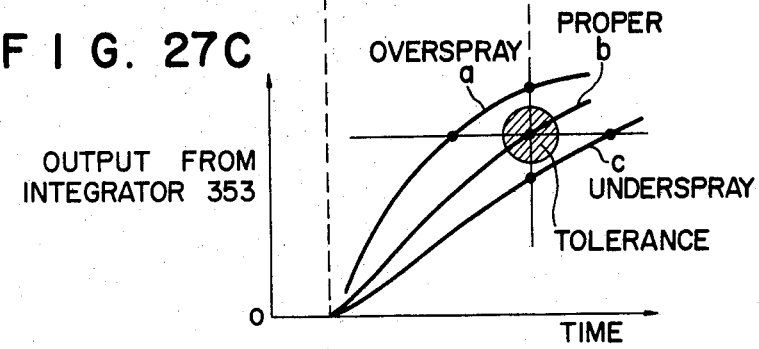

The amplifier 351 is connected to an inverter 352 for the delivery thereto of the amplified electrical output from the photocell 334. Let it now be assumed that as graphically represented in FIG. 27A, the sterilizing liquid is sprayed onto each container 13 during the preassigned length of time when the container stays between the upper and lower sterilizing chambers. Then the intensity of the light falling on the photocell 334 will vary as depicted by way of example in FIG. 27B, decreasing toward the end of the spray period because of the increasing spray or mist density in the upper sterilizing chamber 39*e*. The inverter 352 inverts, or turns upside down, the output waveform of the amplifier 351. FIG. 27C represents the thus inverted waveform, which corresponds to the change with time of the spray density in the upper sterilizing chamber 39*e* during one spray period.

The output of the inverter 352 is connected to an integrating network 353 (hereinafter referred to as the integrator), the output of which is connected to a comparator circuit 354. The integrator 353 has another input connected to a pulse generator 355, which in turn is connected to the computer 349 via the start-stop circuit 350.

Under the control of the computer 349 the pulse generator 355 delivers its output pulses to the integrators 353. The integrator uses these input pulses for splitting the input waveform received from the inverter 352, and produces an output waveform which is the integral of the input waveform. FIG. 27D shows three possible output waveforms of the integrator 353. The integrator 353 delivers its output to the comparator circuit 354.

In FIG. 27D, let the curve a represent overspray, the curve b proper spray, and the curve c underspray. Then the value of the curve b at the end of the spray period can be used as the reference with which the output from the integrator 353 is to be compared by the comparator circuit 354. As will be apparent from the foregoing, this reference is the integral, over one of the successive, spaced-apart spray periods, of the output from the inverter 352 in the case where the correct amount of the sterilizing liquid has been sprayed during the spray period.

There are two possible methods of comparing the output from the integrator 353 with the reference in the comparator circuit 354. One is to compare the integrator output with the reference in terms of relative magnitude as at the end of each spray period. The other is to constantly compare, as during and after each spray period, the output magnitude of the integrator 353 with the reference. According to this second method, whether the correct amount of the sterilizing liquid is being sprayed or not is ascertained from the time (earlier or later than the end of each spray period) when the integrator output magnitude rises to the reference. Whichever method is employed, it will be practical to allow a certain tolerance, as indicated by the hatched circle in FIG. 27D.

Figure 28:
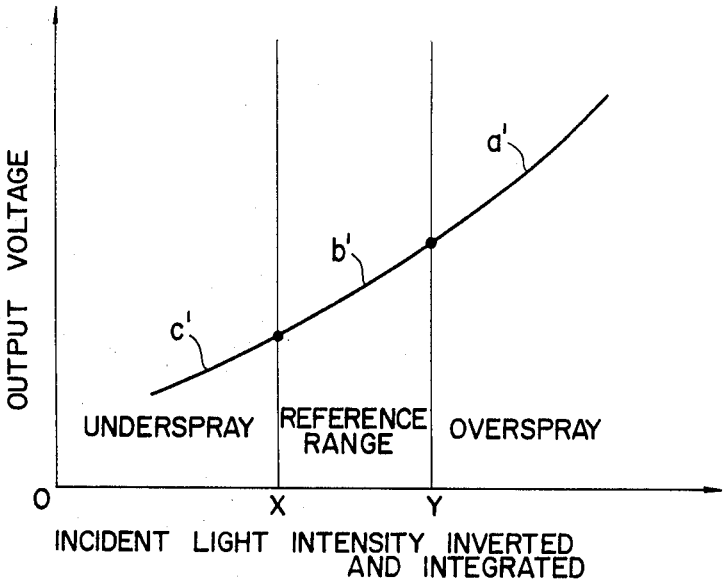
FIG. 28 is a graph explanatory of the operation of the spray density detecting system of FIG. 26.

FIG. 28 is explanatory of the manner in which, in accordance with the first described method, the comparator circuit 354 compares the integrator output magnitude with the reference at the end of each spray period. The reference has a tolerance X-Y. In this graph, a′ corresponds to a in FIG. 27D, b′ to b and c′ to c. The comparator circuit 354 produces an "underspray" signal when the input magnitude is below the lower reference limit X, and an "overspray" signal when the input magnitude is above the upper reference limit Y. These comparator output signals, as well as the "proper" signal produced when the input magnitude falls within the reference limits X and Y, are all delivered to the computer 349 as indicated in FIG. 26.

In the practice of this embodiment the reference limits X and Y may be input to the computer 354. The computer can be caused to deliver the signals representative of the reference limits to the comparator circuit 354 at the end of each spray period. The comparator circuit 354 compares these reference limits with the incoming integrator output and produces either of the above three output signals for delivery to the computer 349.

For comparison of the output from the integrator 353 with the reference in accordance with the second described method, the integrator must constantly deliver its output to the comparator circuit 354 during and for some time after each spray period. The comparator circuit 354 produces either one of the aforesaid three output signals depending upon the time when the integrator output magnitude reaches the reference. This second method requires the connection of a time counter 356 between pulse generator 355 and comparator circuit 354.

The counter 356 starts counting the input pulses at the start of each spray period and delivers each count to the comparator circuit 354. Also delivered to the comparator circuit 354 is the output from the integrator 353 corresponding to each count being input from the counter 356. The comparator circuit 354 further receives from the computer 349 the signal representative of the reference. The comparator circuit 354 produces the "underspray" signal if the integrator output magnitude reaches the reference later than a preset latest moment of time, and the "overspray" signal if the integrator output magnitude reaches the reference earlier than a preset earliest moment of time.

The computer 349 is shown connected to a display device 357 for causing the same, in response to the comparator outputs, to make visible representation as to whether the amount of the sterilizing liquid being sprayed during each spray period i above, below, or within the desired range. The computer 349 may further be connected to suitable control means 358 which, upon delivery of the "underspray" or "overspray" signal from comparator circuit 354 to computer 349, actuate means 359 for removing or rejecting the undersprayed or oversprayed container or containers. Simultaneously the control means 358 may set the filling section 18 (FIG. 1) out of operation. Further the computer 349 may cause readjustment of the rate at which the sterilizing liquid is sprayed from the upper spray nozzle 42*e* or from both upper and lower spray nozzles.

A reset circuit 360 is connected between start-stop circuit 350 and integrator 353 for clearing the latter upon completion of each density-detecting cycle under the control of the computer 349. Although not specifically illustrated, the reset circuit 360 is further connected to the display device 357 for clearing same upon completion of each cycle.

Figure 29:
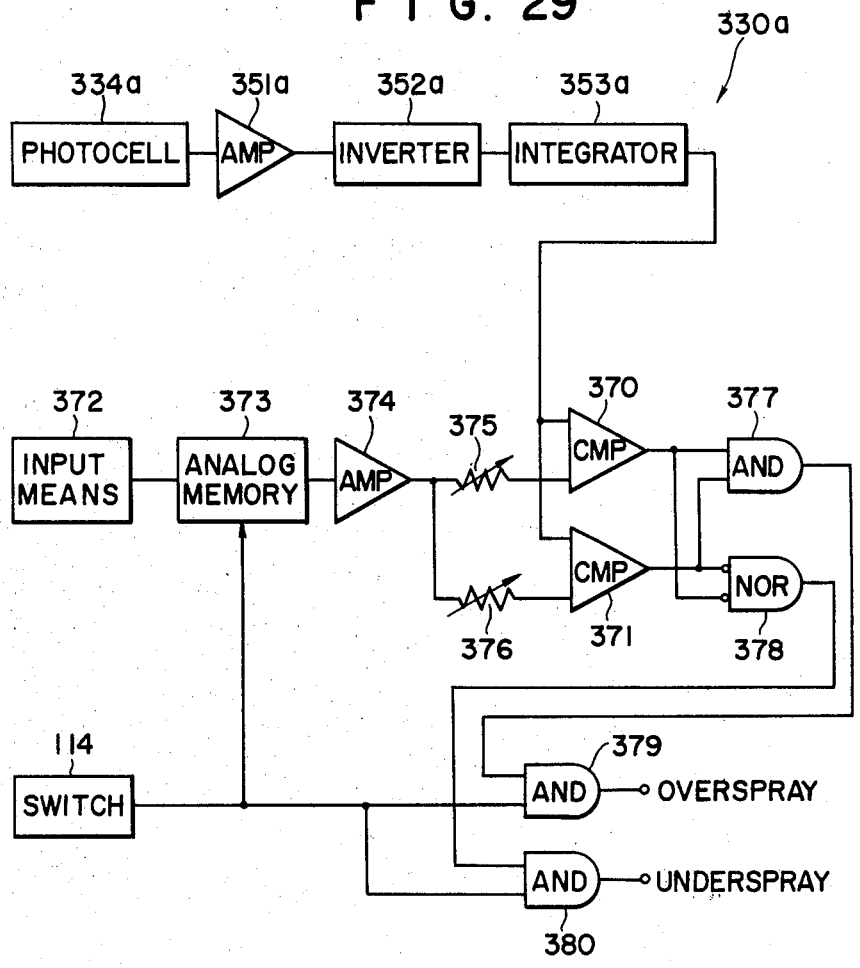
FIG. 29 is a block diagram of a modification of the electronic circuitry included in the spray density detecting system of FIG. 26.

FIG. 29 shows a modified spray or mist density detecting system 330*a*. In this modified system, a photocell 334*a*, amplifier 351*a*, inverter 352*a*, and integrator 353*a* correspond exactly to the photocell 334, amplifier 351, inverter 352, and integrator 353, respectively, in the system 330 of FIG. 26. The modified system 330*a* employs the following means for comparison of the integrator output magnitude with the reference range at the end of each spray period, in accordance with the above explained first method of comparison.

The integrator 353*a* is connected to one of the two inputs of each of two comparators 370 and 371 for delivering thereto its output at the end of each spray period. A suitable data input means 372 is connected via an analog memory 373, an amplifier 374, and respective rheostats 375 and 376 to the other inputs of the comparators 370 and 371. The reference with which the integrator output is to be compared is input from the input means 372 to the comparators 370 and 371. The rheostats 375 and 376 have their resistance values preadjusted to represent the upper Y and the lower X reference limits given in FIG. 28.

The two comparators 370 and 371 are each connected to one of the two inputs of each of AND gate 377 and NOR circuit 378. The AND gate 377 is connected to one of the inputs of another AND gate 379, whereas the NOR circuit 378 is connected to one of the inputs of still another AND gate 380. The switch 114 of FIG. 3, or the computer 349 of FIG. 26, is connected to the other inputs of the AND gates 379 and 380 and to the analog memory 373 for the delivery of the timing signal thereto.

Thus, when the integrator output magnitude is higher than the upper reference limit Y, the "overspray" signal is delivered through the AND gates 377 and 379. The "underspray" signal is delivered through the NOR circuit 378 and AND gate 380 when the integrator output magnitude is lower than the lower reference limit X. This system 330*a* puts out no signal when the integrator output magnitude is within the reference limits X and Y.

Figure 30:
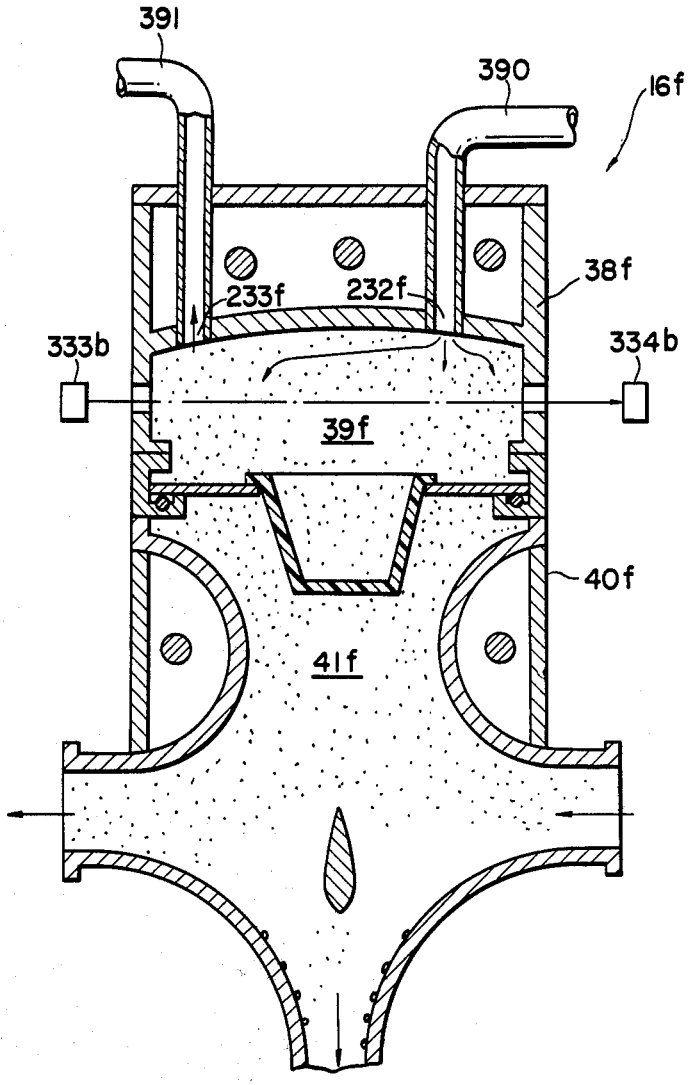
FIG. 30 is a vertical sectional view showing the sterilizing section of FIG. 12 as modified to include the density detecting system of FIG. 26 or 29.

The mist density detecting systems 330 and 330*a* of FIGS. 26 and 29 lend themselves for use with any other of the various sterilizing sections disclosed herein. FIG. 30 shows, by way of example, the sterilizing section 16*d* of FIG. 12 as adapted for use with either of the detecting systems 330 and 330*a*, the thus adapted sterilizing section being generally designated 16*f*. It will be recalled that the sterilizing section 16*d* is intended for use with the ultrasonic atomizing section 200 of FIG. 11, 200*a* of FIG. 14, 200*b* of FIG. 16, 200*c* of FIG. 18, or 200*d* of FIG. 24.

A comparison of FIG. 30 with FIG. 12 will reveal that the lower wall assembly 40*f* of the sterilizing section 16*f* is identical with the lower wall assembly 40*d* of the sterilizing section 16*d*. The upper wall assembly 38*f* of the sterilizing section 16*f* is of different construction from the upper wall assembly 38*d*. One of the differences resides in a mist inlet 232*f* formed in the top of the upper wall assembly 38*f* for receiving the stream of the airborne droplets of the sterilizing liquid from any of the above ultrasonic atomizing sections by way of a conduit 390. A mist outlet 233*f* is also formed in the top of the upper wall assembly 38*f* for exhausting any excess of the incoming mist through a conduit 391.

A light source 333*b* and photocell 334*b* are both disposed outside of the upper wall assembly 38*f* for emitting and receiving a light beam across the upper sterilizing chamber 39*f*. Either the system 330 of FIG. 26 or the system 330*a* of FIG. 29 enables detection of the mist density in the upper sterilizing chamber 39*f*, as the mist is supplied intermittently with the on-off operation of the valve 240 described in connection with FIG. 13. The detection of the mist density in the lower sterilizing chamber 41*f* is unnecessary because both sterilizing chambers receive the mist from a common source.

The "overspray" and "underspray" signals obtained as a result of the mist density detection in the upper sterilizing chamber 39*f* of the sterilizing section 16*f* can be utilized for various purposes depending upon the configuration of the particular ultrasonic atomizing section in use with the sterilizing section 16*f*. For example, if the atomizing section 200 of FIG. 11 is in use, then the signals may be used for readjustment of the voltage impressed to the ultrasonic vibrator 205 and of the flow rate of the carrier air fed into the mist chamber 207. Also, in the atomizing section 200*a* of FIG. 14, the signals can be utilized for readjustment of the pressures under which the sterilizing liquid and air are fed into the ultrasonic atomizer nozzle 260. Further, in the atomizing section 200*b* of FIG. 16, the signals find use for readjustment of the voltage impressed to the ultrasonic vibrator unit 274 and of the flow rate of the carrier air. Still further, in the atomizing sections 200*c* and 200*d* of FIGS. 18 and 24, the signals can be used for readjustment of the voltages impressed to the ultrasonic vibrators 290 and 290*a* and of the flow rates of the carrier air.

Embodiments of FIGS. 31–37

The mist density detecting system 330 of FIG. 26, as well as the system 330*a* of FIG. 29, employs air curtains for preventing the mist from clouding the glazed window through which the light beam is emitted and received. The omission of the air curtains or equivalent means is possible, however, provided that the electronic circuitry of the detecting system is equipped to compensate for the cumulative zero drift caused by the gradual clouding of the glazed windows. This concept is realized in another example of the mist density detecting system shown in FIGS. 31 through 36.

Figure 31:
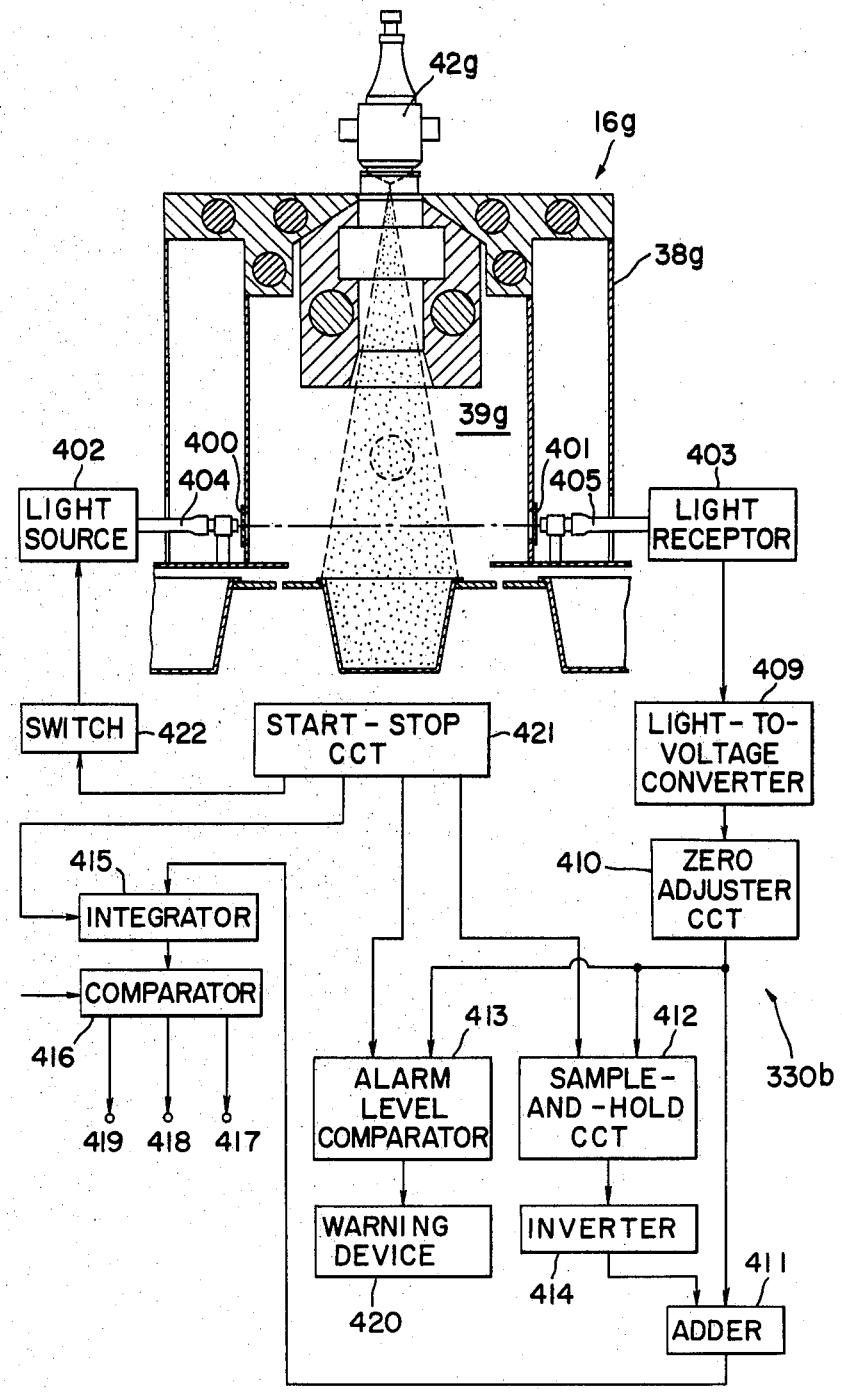
FIG. 31 is a view corresponding to FIG. 26 but showing a modified spray density detecting system.

In FIG. 31 is shown the modified mist density detecting system 330*b* together with a sterilizing section 16*g* which is largely of the type given in FIG. 8. No further description will be necessary about this sterilizing section itself, except to say that the opposite sides of its upper wall assembly 38*g* are of double wall construction and have respective glazed windows at 400 and 401. These windows confront each other across the spray of the sterilizing liquid expelled from the upper spray nozzle 42g.

Disposed outside of the upper wall assembly 38g, a light source 402 and light receptor 403 are optically open to the glazed windows 400 and 401 through bundles of optical fibers 404 and 405, respectively. The light beam emitted by the source 402 travels through the optical fiber bundle 404 and window 400, across the upper sterilizing chamber 39g, and through the window 401 and optical fiber bundle 405, before being received by the receptor 403.

Figure 32:
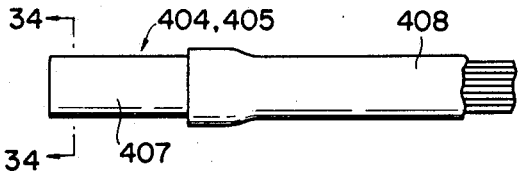
FIG. 32 is an enlarged, fragmentary elevational view of each optical fiber bundle structure used in the spray density detecting system of FIG. 31.
Figure 33:
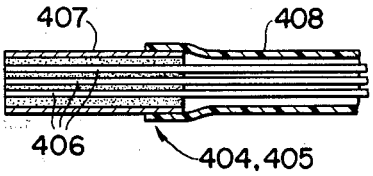
FIG. 33 is a longitudinal sectional view of the optical fiber bundle structure of FIG. 32.
Figure 34:
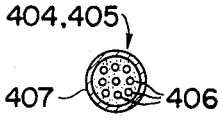
FIG. 34 is a cross sectional view taken along the line 34—34 of FIG. 32.

FIGS. 32, 33 and 34 are enlarged detail views of each of the optical fiber bundles 404 and 405. Each fiber bundle comprises a plurality of optical fibers 406, as of glass, enclosed in and extending through a resin-filled, tubular sheath 407 of stainless steel or the like. The end faces of the fibers 406 have been ground to mirrorlike finish. For connection to the light source 402 or light receptor 403, a black, flexible silicone tube 408 is coupled to the sheath 407 for enveloping the fibers 406 projecting therefrom.

With reference back to FIG. 31 the light source 402 and light receptor 403 are electrically connected to the circuitry shown in block form therein, to provide the detecting system 330b. The provision of a similar system to the lower sterilizing chamber (not shown) of the sterilizing section 16g is not of absolute necessity. The light receptor 403 is connected to a light-to-voltage converter 409 capable of generating a voltage representative of the varying density of the spray or mist in the upper sterilizing chamber 39g. The output of the light-to-voltage converter 409 is connected to a zero adjuster circuit 410 for setting the zero level.

The output of the zero adjuster circuit 410 is connected to an adder 411, a sample-and-hold circuit 412, and an alarm level comparator circuit 413. The output of the sample-and-hold circuit 413. The output of the sample-and-hold circuit 412 is connected via an inverter circuit 414 to another input of the adder 411. The sample-and-hold circuit 412 produces a signal representative of the incremental zero drift caused by the clouding of the glazed windows 400 and 401. Receiving this output from the sample-and-hold circuit 412, the inverter circuit 414 produces a corresponding negative output. The adder 411 adds this output from the inverter circuit 414 and the output from the light-to-voltage converter 409.

The output of the adder 411 is connected to an integrator 415 and thence to a comparator circuit 416 having three output terminals 417, 418 and 419. The integrator 415 integrates the adder output during each preassigned period of time, and the comparator circuit 416 compares the integrator output against the predetermined upper and lower reference limits. The comparator circuit 416 produces the "overspray" signal from the output terminal 417 when the integrator output magnitude is higher than the upper reference limit, the "proper" signal from the output terminal 418 when the integrator output magnitude is within the reference limits, and the "underspray" signal from the output terminal 419 when the integrator output magnitude is lower than the lower reference limit.

The output of the alarm level comparator circuit 413 is connected to a suitable warning device 420. This warning device gives an alarm when the zero drift due to the clouding of the glazed windows increases to a predetermined limit.

Shown at 421 is a start-stop circuit performing various functions hereinafter set forth. The start-stop circuit 421 is connected to the sample-and-hold circuit 412, the alarm level comparator circuit 413, the integrator 415, the comparator circuit 416, and a switch 422. Connected to the light source 402, the switch 422 is to be actuated from the start-stop circuit 421 for turning the light source on and off at the start and the end of operation.

Figure 35:
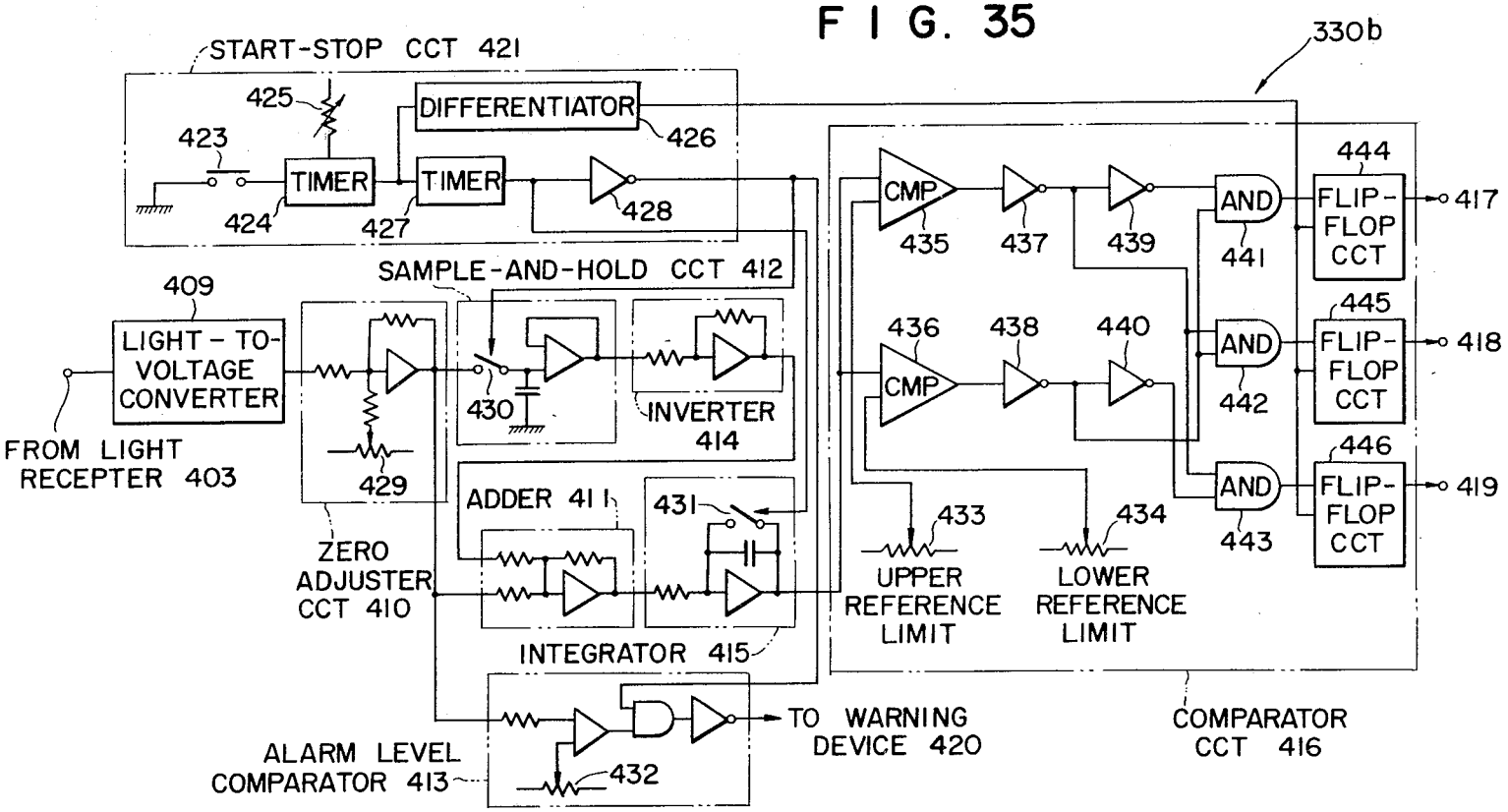
FIG. 35 is a more detailed diagram, partly in block-schematic form, of the electronic circuitry in the spray density detecting system of FIG. 31.

FIG. 35 is a more detailed diagram of the electronic circuitry of the detecting system 330b. The start-stop circuit 421 comprises a start-stop switch 423 to be actuated manually, a timer 424 connected to the switch 423 and having a rheostat 425, a differentiator 426 connected to the output of the timer 424, another timer 427 also connected to the output of the timer 424, and an inverter 428 connected to the output of the second mentioned timer 427. The first timer 424 is for setting the periods of time during which the sterilizing liquid is sprayed. The second timer 427 is for setting the periods of time during which the output from the adder 411 is integrated by the integrator 415. The spray periods and the integration periods are thus set differently, for a reason later referred to.

The zero adjuster circuit 410 has a rheostat 429 for establishing the initial zero level. The sample-and-hold circuit 412 has a switch 430 actuated by the output from the inverter 428 of the start-stop circuit 421. Thus the sample-and-hold circuit 412 measures or samples the input signal at the end of each integration period and holds the sample until the end of the next integration period. The integrator 415 has a reset switch 431 actuated by the output from the second timer 427 in the start-stop circuit 421. The reset switch 431 is to be closed at the end of each integration period for clearing the integrator 415. The alarm level comparator circuit 413 has a rheostat 432 for setting the noted limit to which the zero drift is allowed to increase with the progress of successive sprays.

Included in the comparator circuit 416 are a first rheostat 433 for setting the upper reference limit, and a second rheostat 434 for setting the lower reference limit. The first rheostat 433 is connected to one of the inputs of a first comparator 435, to the other input of which is connected the integrator 415. The second rheostat 434 is connected to one of the inputs of a second comparator 436, to the other input of which is likewise connected the integrator 415. The outputs of the first 435 and the second 436 comparators are connected to respective inverters 437 and 438 and thence to respective additional inverters 439 and 440.

The comparator circuit 416 further comprises first 441, second 442, and third 443 AND gates, and first 444, second 445, and third 446 flip-flop circuits. The first AND gate 441 has its two inputs connected to the inverters 439 and 438 respectively. The second AND gate 442 has its two inputs connected to the inverters 437 and 438 respectively. The third AND gate 443 has its two inputs connected to the inverters 437 and 440 respectively. The outputs of the three AND gates 441, 442 and 443 are connected to the respective flip-flop circuits 444, 445 and 446. Each of these flip-flop circuits has another input connected to the differentiator 426 of the start-stop circuit 421. The outputs of the flip-flop circuits 444, 445 and 446 are connected respectively to the aforesaid three output terminals 417, 418 and 419 for the delivery of the "overspray", "proper", and "underspray" signals.

Figure 36:
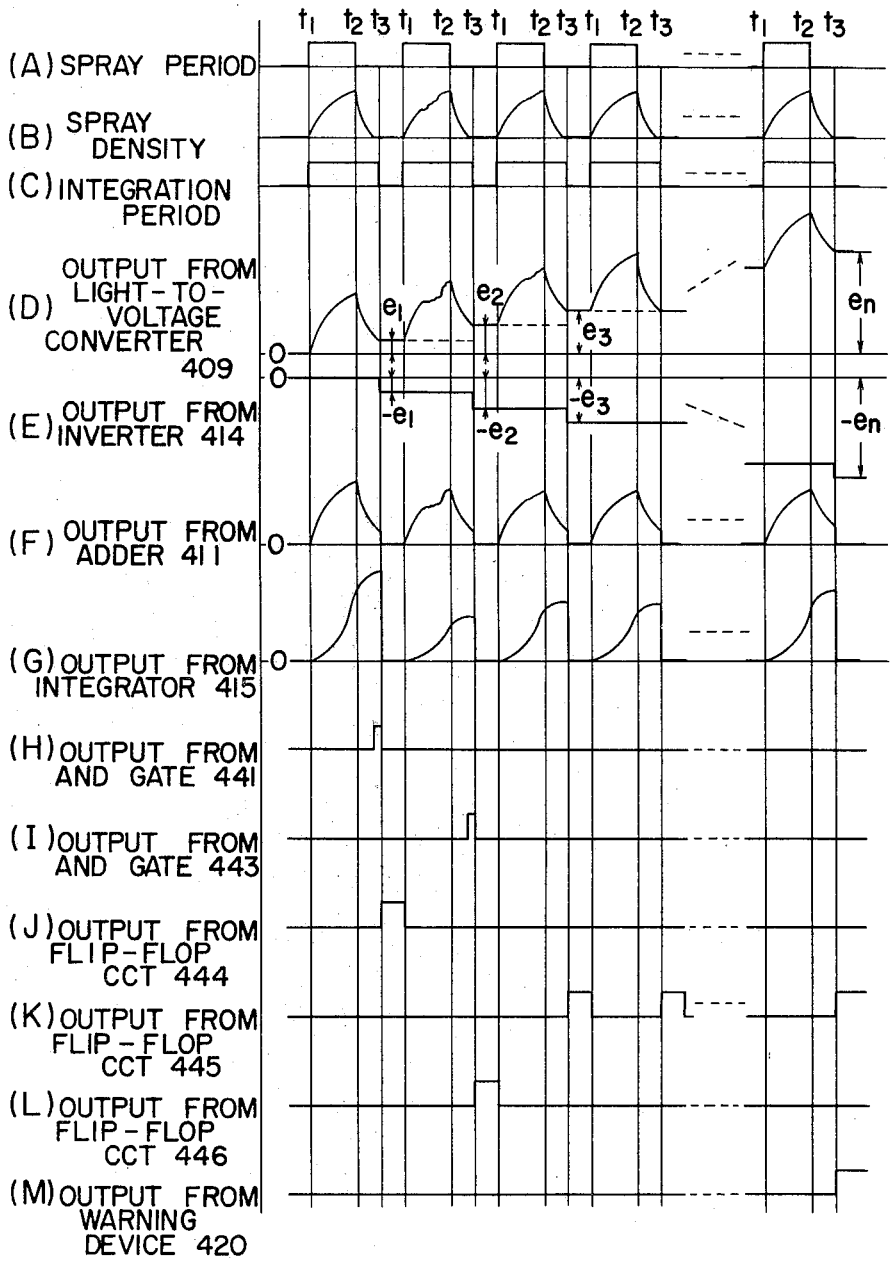
FIG. 36 is a chart of waveforms useful in explaining the operation of the spray density detecting system of FIG. 31.

Although the foregoing description will have largely made clear the operation of the detecting system 330*b*, further amplification will be made, with reference to the chart of pertinent waveforms given in FIG. 36, in the following brief summary of such operation.

Upon manual actuation of the switch 423 in the start-stop circuit 421, the switch 422 is closed to cause the light source 402 to emit a beam of light across the upper sterilizing chamber 39*g* of the sterilizing section 16*g*. The timer 424 of the start-stop circuit 421 also acts to cause the upper and lower spray nozzles of the sterilizing section 16*g* to spray the sterilizing liquid at intervals, in step with the intermittent feed motion of the successive containers to be sterilized, as indicated in FIG. 36(A). Each spray period lasts from moment t1 to moment t2 in time. The spray nozzles do not produce sprays during time intervals each lasting from moment t2 to subsequent moment t1.

FIG. 36(B) plots the varying mist densities in the upper sterilizing chamber 39g. It will be observed from this figure that the mist density returns to zero upon lapse of some time after the end (at moment t2) of each spray period. Since the expelled droplets of the sterilizing liquid do not immediately reach the container being sterilized, the timer 427 in the start-stop circuit 421 causes the integrator 415 to integrate the input signal from each moment t1 to moment t3, the latter moment being intermediate between moment t2 and subsequent moment t1, as in FIG. 36(C). Thus each spray period and each integration period both start at moment t1, the spray period ending at moment t2 and the integration period ending at later moment t3.

FIG. 36(D) represents the output waveform of the light-to-voltage converter 409 corresponding to the varying mist densities in the upper sterilizing chamber 39g. Even though the zero level of the output voltage has initially been set by the rheostat 429 of the zero adjuster circuit 410, the output voltage of the light-to-voltage converter 409 does not return to the present zero level at moment t3, when the actual mist density is zero, owing to the clouding of the glazed windows 400 and 401. The initial zero drift is labeled el. The zero drift increases by increments with the successive sprays, from e1 to e2 and then to e3, until it reaches the predetermined limit en.

The sample-and-hold circuit 412 measures the zero drift at the end of each integration period and holds the value until the end of the next integration period. The output from the sample-and-hold circuit 412, which is positive, is turned negative by the subsequent inverter circuit 414. FIG. 36(E) shows the consequent inverter output, decreasing in magnitude from −el through −e2, −e3, . . . . to −en with the successive sprays.

Receiving the output from the zero adjuster circuit 410 and the output from the inverter circui 414, the adder 411 produces the output depicted in FIG. 36(F). This adder output is the sum of the signals given in FIGS. 36(D) and 36(E) and very nearly represents the actual spray densities of FIG. 36(B) since now the incremental zero drift has been cancelled.

The integrator 415 integrates the above adder output during each integration period t1–t3 and produces the output shown in FIG. 36(G). The integrator 415 is cleared at each moment t3, as then its reset switch 431 is closed by the output from the timer 427 in the start-stop circuit 421, and resumes integration of the input signal at subsequent moment t1.

The comparator circuit 416 compares each of the successive outputs from the integrator 415 with the upper and lower reference limits. According to the example of FIG. 36 the first integrator output is higher than the upper reference limit, with the result that the AND gate 441 produces an output pulse as in FIG. 36(H). The second integrator output is lower than the lower reference limit. In this case the AND gate 443 produces an output pulse as in FIG. 36(I). The AND gates 441 and 443 deliver these output pulses to the respective flip-flop circuits 444 and 446, causing the same to put out the "overspray" and "underspray" signals given in FIGS. 36(J) and 36(L). The third and fourth integrator outputs are within the reference range, so that the flip-flop circuit 445 puts out the "proper" signal as in FIG. 36(K).

The alarm level comparator circuit 413 effects integration of the input signal corresponding to the inverted zero drift −e1, −e2, . . . of FIG. 36(E). When the zero drift increases the the allowed maximum en, the alarm level comparator circuit 413 causes the warning device 420 to give a suitable alarm as in FIG. 36(M). In response to this alarm the glazed windows 400 and 401 of the sterilizing section 16*g* may be wiped clean to eliminate the zero drift. The density detection operation can then be resumed in the above described manner.

Figure 37:
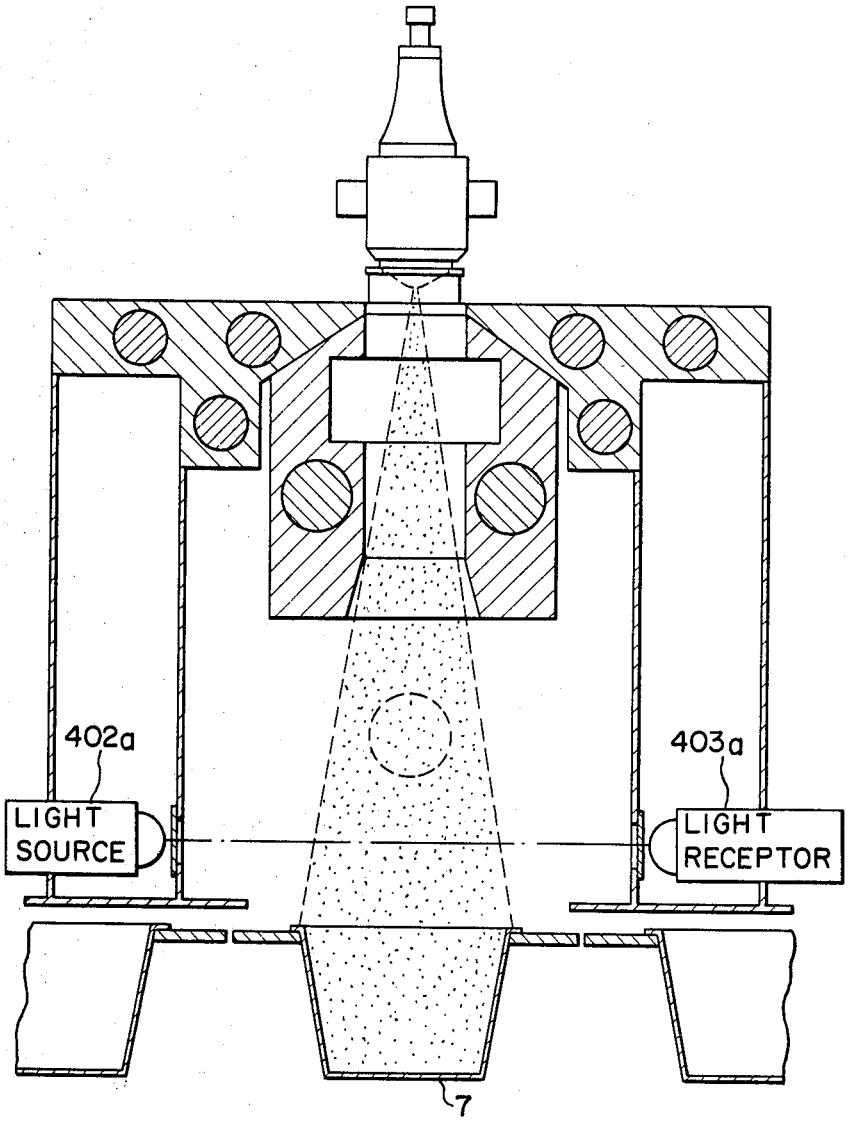
FIG. 37 is a view similar to FIG. 31 but showing a slight modification of the spray density detecting system.

If desired, the light source and the light receptor in the mist density detecting system 330*b* may be disposed immediately outside of the glazed windows, as shown at 402*a* and 403*a* in FIG. 37. This arrangement is not recommended, however, because the light source and receptor are both susceptible to the attack by heat and by the mist of the sterilizing liquid. The alternative arrangement may also necessitate the use of reflectors, making it difficult to adjust the optical axis. The reflectors will further be clouded or soiled with the lapse of time and introduce a loss in the radiation incident to the light receptor. All these difficulties are absent in the arrangement of FIG. 31, in which the optical fiber bundles permit the light source and receptor to be disposed in any convenient, easy-of-maintenance locations remote from the glazed windows.

It will further be seen that regardless of the arrangement of the light source and receptor, the detecting system 330*b* is also applicable to the sterilizing section of the type shown in FIG. 30. In this application the spray periods of FIG. 36(A) correspond to the periods during which the ultrasonically atomized sterilizing solution is fed into the sterilizing chambers from either of the various ultrasonic atomizing sections disclosed herein.

While several embodiments of the present invention have been shown and described herein, it will be understood that they are illustrative only and are not intended to impose limitations on the invention, which comprehends any and all equivalent devices within the scope of the following claims.

What is claimed is:

1. Apparatus for sterilizing successive articles being fed along a predetermined path, comprising:

means for feeding the articles along the predetermined path at least in one row;

means defining two opposed sterilizing chambers on the opposite sides of the predetermined path;

means for supplying a sterilizing liquid as a fine spray into the sterilizing chambers, said supplying means including two spray nozzles for spraying the sterilizing liquid into the respective sterilizing chambers, whereby the successive articles traveling between the sterilizing chambers are sterilized;

means for heating the sterilizing chambers and the supplying means;

means defining in each of the sterilizing chambers a spray channel through which the spray expelled from one of the spray nozzles travels toward the article being sterilized; and means defining a confined air chamber in each of the sterilizing chambers, the spray channels being laterally open to the respective air chambers, whereby the air chambers serve to reduce the velocities of the sprays traveling through the spray channels.

2. The sterilizing apparatus according to claim 1, wherein the confined air chamber communicates with the associated spray channel at a position intermediate between the two longitudinal ends of the spray channel.

3. The sterilizing apparatus according to claim 1, wherein the feeding means feeds the articles intermittently, and wherein the apparatus further comprises means for causing the supplying means to supply the sterilizing liquid into the sterilizing chambers only when the successive articles are at rest between the sterilizing chambers.

4. The sterilizing apparatus according to claim 3, further comprising means for exhausting any excess of the supplied sterilizing liquid from the sterilizing chambers during the time intervals when the successive articles are being fed to the position between the sterilizing chambers.

5. The sterilizing apparatus according to claim 1, wherein the feeding means feeds the articles in a plurality of rows, whereby a plurality of the articles can be simultaneously sterilized between the sterilizing chambers.

6. The sterilizing apparatus according to claim 5, wherein the supplying means comprises two groups of spray nozzles for spraying the sterilizing liquid into the respective sterilizing chambers, at least either of the two groups of spray nozzles being so arranged relative to each other and to the articles being sterilized that the sprays expelled therefrom overlap each other.

7. The sterilizing apparatus according to claim 1, further comprising means for heating the spray channels and the air chambers.

8. An apparatus for sterilizing successive articles being fed along a predetermined path, comprising:

means for feeding the articles along the predetermined path at least in one row;

means defining two opposed sterilizing chamber members on the opposite sides of the predetermined path, the sterilizing chambers being defined by respective wall assemblies, each wall assembly including a wall member;

means for supplying a sterilizing liquid in a fine spray into the sterilizing chambers whereby the successive articles traveling between the sterilizing chambers are sterilized, said supplying means comprising two spray nozzles for spraying the sterilizing liquid into the respective sterilizing chambers, each of said spray nozzles being mounted on each of said wall members for spraying sterilizing liquid therethrough;

means for heating the sterilizing chambers and the supplying means;

a spray retarder block mounted in each sterilizing chamber so as to provide air passages between itself and the wall member of the wall assembly dividing the sterilizing chamber;

therebeing a spray channel extending through each spray retarder block for the passage therethrough of the spray expelled from one of the spray nozzles, each spray channel having and entrance end in direct communication with the air passages;

therealso being at least one air supply chamber formed in each spray retarder block, the spray channel in each spray retarder block being laterally open to the air chamber, whereby the air chamber serves to reduce the velocity of the spray passing through the spray channel; and means for adjustably varying the rate at which air is drawn from the air passages into the entrance and each spray channel wall the spray is passing therethrough.

9. The sterilizing apparatus according to claim 8, wherein the adjustably varying means comprises a plurality of fastener elements connecting each spray retarder block to the wall member of one of the wall assemblies, the fastener elements permitting the spray retarder block to be adjustably moved toward and away from the wall member.

10. The sterilizing apparatus according to claim 8, wherein the adjustably varying means comprises valve means provided to the air passages.

11. A sterilizing apparatus for sterilizing successive articles being fed along a predetermined path, comprising;

means for feeding the articles along the predetermined path at least in one row;

means defining two opposed sterilizing chambers on the opposite sides of the predetermined path;

means for supplying sterilizing liquid as a fine spray into the sterilizing chambers, whereby the successive articles traveling between the sterilizing chambers are sterilized, the supplying means comprising:

means for ultrasonicly atomizing the sterilizing liquid into mist; and means for directly the mist from the atomizing means into the sterilizing chambers.

12. The sterilizing apparatus according to claim 11, wherein the atomizing means comprises:

(a) a liquid vessel for containing a liquid;

(b) ultrasonic vibrator means mounted to the liquid vessel for generating ultrasonic vibrations for transmission through the liquid in the liquid vessel; and (c) a resonator vessel for containing the sterilizing liquid to be atomized, the resonator vessel being at least partly immersed in the liquid in the liquid vessel and being capable of resonating with the ultrasonic vibrator means for atomizing the sterilizing liquid contained therein.

13. The sterilizing apparatus according to claim 12, wherein the atomizing means further comprises:

(a) means defining a mist chamber immediately over the resonator vessel for accommodating the ultrasonically created mist prior to its delivery into the sterilizing chambers; and (b) the mist chamber having an air inlet for receiving carrier air under pressure, and a mist outlet for permitting the mist to be carried away toward the sterilizing chambers by the carrier air.

14. The sterilizing apparatus according to claim 12, wherein the resonator vessel is hemispherical in shape.

15. The sterilizing apparatus according to claim 11, wherein the atomizing means comprises:

(a) means defining a mist chamber;

(b) an atomizer nozzle projecting into the mist chamber for expelling streams of the sterilizing liquid and air therein;

(c) a resonator mounted in front of the atomizer nozzle so as to be impinged by the streams of the sterilizing liquid and air, the thus impinged resonator vibrating at an ultrasonic frequency to atomize the sterilizing liquid; and (d) the mist chamber having a mist outlet for permitting the mist of the sterilizing liquid to be carried away toward the sterilizing chambers by the air expelled from the atomizer nozzle.

16. The sterilizing apparatus according to claim 11, wherein the atomizing means comprises:

(a) means defining a mist chamber;

(b) means defining an air chamber in direct communication with the mist chamber;

(c) the air chamber having an air inlet for receiving carrier air under pressure, the carrier air being introduced from the air chamber into the mist chamber;

(d) an atomizer assembly mounted in the air chamber for expelling ultrasonically created mist of the sterilizing liquid into the mist chamber; and (e) the mist chamber having a mist outlet for permitting the mist to be carried away toward the sterilizing chambers by the carrier air.

17. The sterilizing apparatus according to claim 13, 15 or 16, wherein the supplying means further comprises means for feeding back into the mist chamber a portion of the mist being directed from the mist chamber toward the sterilizing chambers.

18. The sterilizing apparatus according to claim 11, wherein the atomizing means comprises:

(a) means defining a liquid chamber to be filled with a liquid;

(b) at least one ultrasonic vibrator means mounted at the bottom of the liquid chamber for generating ultrasonic vibrations for transmission through the liquid in the liquid chamber;

(c) means defining an atomizing chamber over the liquid chamber, the atomizing chamber being for receiving the sterilizing liquid to be atomized;

(d) a partition separating the liquid chamber and the atomizing chamber from each other;

(e) there being at least one opening formed in the partition; and (f) a resonator film liquid-tightly closing the opening in the partition, the resonator film being capable of resonating with the ultrasonic vibrator means for atomizing the sterilizing liquid contained in the atomizing chamber.

19. The sterilizing apparatus according to claim 11, wherein the atomizing means comprises:

(a) a wall assembly defining an atomizing chamber for receiving the sterilizing liquid to be atomized, the wall assembly having a bottom;

(b) there being at least one opening formed in the bottom of the wall assembly;

(c) ultrasonic vibrator means disposed under the opening in the bottom of the wall assembly for generating ultrasonic vibrations; and (d) a resonator film liquid-tightly closing the opening in the bottom of the wall assembly, the resonator film being capable of resonating with the ultrasonic vibrator means for atomizing the sterilizing liquid contained in the atomizing chamber.

20. The sterilizing apparatus according to claim 18 or 19, wherein the resonator film is of plastics material.

21. A sterilizing apparatus for sterilizing successive articles being fed along a predetermined path, comprising:

means for feeding the articles along the predetermined path at least in one row;

means defining two opposed sterilizing chambers on the opposite sides of the predetermined path;

means for supplying a sterilized liquid as a fine spray into the sterilizing chambers, whereby the successive articles traveling between the sterilizing chambers are sterilized;

means for heating the sterilizing chambers and the supplying means;

a light source for emitting a beam of light across at least one of the two opposing sterilizing chambers;

means for receiving the light beam and generating electrical output representative of the density of the droplets of the sterilizing liquid in the sterilizing chambers;

integrator means for integrating the output from the receiving and generating means during each of the successive prescribed period of time; and comparative means for comparing the output from the integrator means with a predetermined reference representative of the intergral, during one of the prescribed periods of time, of the output from the receiving and generating means in the case where a desired amount of the finely sprayed sterilizing liquid is supplied into the sterilizing chamber.

22. The sterilizing apparatus according to claim 21, wherein the comparator means compares the output from the interator means with the predetermined reference in terms of relative magnitude at the end of each prescribed period of time.

23. The sterilizing apparatus according to claim 21, wherein the comparator means compares the output from the integrator means with the predetermined reference in terms of time when the former becomes equal to the latter in magnitude.

24. The sterilizing apparatus according to claim 21, further comprising means for forming air curtains between the light source and said one sterilizing chamber and between the receiving and generating means and said one sterilizing chamber.

25. A sterilizing apparatus for sterilizing successive articles being fed along a predetermined path, comprising:

means for feeding the articles along the predetermined path at least in one row;

means defining two opposed sterilizing chambers on the opposite sides of the predetermined path;

means for supplying a sterilizing liquid as a spray into the sterilizing chambers whereby the successive articles traveling between the sterilizing chambers are sterilized;

means for heating the sterilizing chambers and the supplying means;

a light source permitting a beam of light across at least one of the two opposed sterilizing chambers;

means for receiving the light beam and generating an electrical output representative of the density of the droplets of the sterilizing liquid in the sterilizing chamber;

sample-and-hold means for sampling the output from the receiving and generating means at the end of each of successive prescribed periods of time for holding the sample until the end of the next prescribed period of time;

inverter means for inverting the output from the sample-and-hold means;

adder means for adding the output from the receiving and generating means and the output from the inverter means;

integrator means for integrating the output from the adder means during each of the successive prescribed periods of time; and comparator means for comparing the output from the integrator means with a predetermined reference.

26. The sterilizing apparatus according to claim 25, further comprising means for giving an alarm when the output from the sample-and-hold means reaches a predetermined level.

* * * * *